US005568691A

United States Patent [19]

Rubin

[11] Patent Number: 5,568,691

[45] **Date of Patent: *Oct. 29, 1996**

[54] HAIR DRYER APPARATUS ADAPTED FOR MULTI-FUNCTIONAL USAGE

[75] Inventor: Richard H. Rubin, Donvale, Australia

[73] Assignee: Secajo, Ltd., Rarotonga, Cook Islands

[ * ] Notice: The term of this patent shall not extend beyond the expiration date of Pat. No. 5,351,417.

[21] Appl. No.: 318,046

[22] Filed: Oct. 4, 1994

Related U.S. Application Data

[63] Continuation-in-part of Ser. No. 949,470, Sep. 23, 1992, Pat. No. 5,351,417.

[51] Int. Cl.[6] ..... F26B 19/00

[52] U.S. Cl. ..... 34/98; 392/380

[58] Field of Search ..... 34/90, 91, 96, 34/97, 572, 98; 392/379–382

[56] References Cited

U.S. PATENT DOCUMENTS 5,351,417 10/1994 Rubin ..... 34/90

*Primary Examiner*—John M. Sollecito
*Assistant Examiner*—Steve Gravini
*Attorney, Agent, or Firm*—Ladas & Parry

[57] ABSTRACT

A multi-functional assembly of a hair dryer and accessory units in which a base unit is attached to a wall for producing heated air which is supplied to a hand-held dryer. A garment dryer is attachable in the assembly to receive the heated air produced by the base unit. The accessory units are capable of being detachably interconnected with one another and with the base unit in a variety of ways. The interconnection is made by security connectors to prevent unauthorized disconnection of the units. Electrical power is supplied to circuit boards in the base unit and the electrical power is transmitted to the accessory units when they are connected in the assembly. A ground fault circuit interrupter or similar safety device in the base unit controls electrical supply to all units. When the accessory unit is a garment dryer, the dryer drum is driven by a turbine wheel, driven by heated air. The drive turbine of the wheel is utilized to produce electrical energy to achieve various functions, such as door latching, alarm signal generation, moisture determination, etc.

30 Claims, 26 Drawing Sheets

111
12 VDC OUT
121
118
GFCI AND TIMER CIRCUIT BOARD 110
119
117
120
115
116
21
NO
28
NO
20
TIMER SWITCH 122
113a
113
GFCI 114
112
220V

HAIR DRYER APPARATUS ADAPTED FOR MULTI-FUNCTIONAL USAGE

CROSS RELATED APPLICATION

This application is a continuation-in-part of Ser. No. 949,470 filed Sep. 23, 1992 now U.S. Pat. No. 5,351,417.

FIELD OF THE INVENTION

The invention relates to hair dryer apparatus adapted for multi-functional usage in which a plurality of accessory units can be selectively utilized in the apparatus. Such accessory units may include such electrical utilization means as electric shaver sockets, an air freshener, an illuminated mirror, a radio, a television set and the like.

The multi-functional usage of the hair dryer apparatus also includes using the heated air from a hand-held hair dryer of the apparatus for a tumble dryer, hand and nail drying, room heating, defogging purposes and the like.

BACKGROUND AND PRIOR ART

In my earlier Patent 4,868,998, there is disclosed the use of a tumble dryer in a hair dryer apparatus in which the rotation of a drum of the tumble dryer and the source of drying heat is obtained from the heated air produced by the hand-held hair dryer of the apparatus. The constructing of the hair dryer itself is disclosed in my Patent 4,700,049.

The hair dryer apparatus is intended for use in a bathroom. There are two major safety requirements for the usage of such apparatus in a bathroom:

i) Any electrical appliance used in a bathroom must not be allowed to come into contact with water, especially when switched on, as the electrical current always remains in the product. The reason is that the contact of water and electricity can cause death by electrocution.

ii) More than one appliance cannot be operated off one power point. Therefore, technically speaking each product, for example, a hair dryer garment dryer, air freshener, illuminated vanity mirror, and the like, must have its own power supply and Ground Fault Circuit Interrupter (GFCI), which will trip the electrical supply to the product as soon as contact with water is made. This involves a substantial cost to the user, whether a private homeowner or a hotel for a separate power supply, inclusive of a GFCI for each product.

I have provided a wall mounted hair dryer apparatus combining the hand-held hair dryer and electrical outlets for an electrical shaver into one unit. By utilizing an electronic control board, which distributes electrical power to both constituents in the unit, a multi-functional product is obtained which only requires one electrical power source.

An important fact of this apparatus is that all the electrical power supply is contained in a housing mounted on the wall. To operate the hair dryer, the user simply removes the handle of the hair dryer from its temporary support in the housing, whereupon the hair dryer is automatically activated. Therefore, there is no need for human contact with the electricity near water. Because the housing is fixed to the wall and therefore cannot be dropped into water, the product is safe for use in the bathroom.

A disadvantage of the combined unit is that not all users want the shaver outlets and it becomes necessary to manufacture and store both the combined units and those with the dryer alone.

SUMMARY OF THE INVENTION

An object of the invention is to provide hair dryer apparatus having a multi-functional usage which avoids the deficiencies of heretofore known combined units while meeting all safety requirements.

A further object of the invention is to provide such apparatus which gives a multi-functional usage in which the configuration of the apparatus for the different usages is quickly and securely effected by selective use of one or more of a plurality of interchangeable modules. This object is satisfied by hair dryer apparatus adapted for multi-functional use comprising a housing attachable to a wall, a hand-held hair dryer, electrical power supply means within said housing, an electrical cable connecting said hand-held dryer to said electrical power supply means, switch means for controlling electrical connection of said electrical cable to said electrical power supply means, said hand-held dryer producing heated air when connected to said electrical power supply means, said housing including a receptacle for said hand-held dryer with an opening at said receptacle through which heated air produced by said dryer is introduced into said housing, at least one air outlet in said housing, and control means accessible from outside said housing for selectively directing the heated air from said dryer to said air outlet.

Another object of the invention is to provide heated air flow and electrical power to said interchangeable modules from a common source of heated air and a common electrical power supply.

Another object of the invention is to provide such apparatus which has exceptional electrical safety requirements. This object is satisfied by utilizing the electrical power cord of the hand-held dryer to electrically connect the dryer to the power source only after the power cord is extended from the housing by a pre-set amount and by providing a GFCI in the electrical power supply.

A further object of the invention is to provide multifunctional usage of the heated air from the hand-held dryer for hand and nail drying, room heating, mirror defogging, and as a heating source for a tumble dryer or the like. This object is satisfied by hair dryer apparatus adapted for multi-functional use comprising a housing attachable to a wall, a hand-held hair dryer, electrical power supply means within said housing, an electrical cable connecting said hand-held dryer to said electrical power supply means, switch means for controlling electrical connection of said electrical cable to said electrical power supply means, said hand-held dryer producing heated air when connected to said electrical power supply means, said housing including a receptacle for said hand-held dryer with an opening at said receptacle through which heated air produced by said dryer is introduced into said housing, at least one air outlet in said housing, and control means accessible from outside said housing for selectively directing the heated air from said dryer to said air outlet.

Another object of the invention is to utilize a common electrical input as an electrical power supply for interchangeable modules which can be of wide-ranging type including units with shaver plugs, air fresheners, illuminated mirrors, and the like. This object is satisfied by hair dryer apparatus adapted for multi-functional use comprising a housing attachable to a wall, a hand-held hair dryer, electrical power supply means within said housing, an electrical cable connecting said hand-held dryer to said electrical power supply means, switch means for controlling electrical connection of said electrical cable to said electrical power supply means, said hand-held dryer producing heated air when connected to said electrical power supply means, said housing including a receptacle for said hand-held dryer with an opening at said receptacle through which heated air produced by said dryer is introduced into said housing, a plurality of modular accessory units, means in said housing for detachable connection of a selected modular accessory unit to said housing, circuit means connected to said electrical supply means for providing an electrical outlet connection in said housing, each said modular accessory unit including electrical utilization means with inputs which are electrically connected to said electrical outlet connection when the accessory unit is connected to said housing.

Yet another object of the invention is to provide multifunction apparatus in which the tumble dryer is utilized without the hair dryer.

A further object of the invention is to drive the tumble dryer by a turbine wheel which is itself driven by heated air supplied to the dryer. In further accordance with the invention,m the turbine wheel which is utilized to generate electrical power suitable for driving a multitude of electrical utilization means.

DETAILED DESCRIPTION

Figure 1:
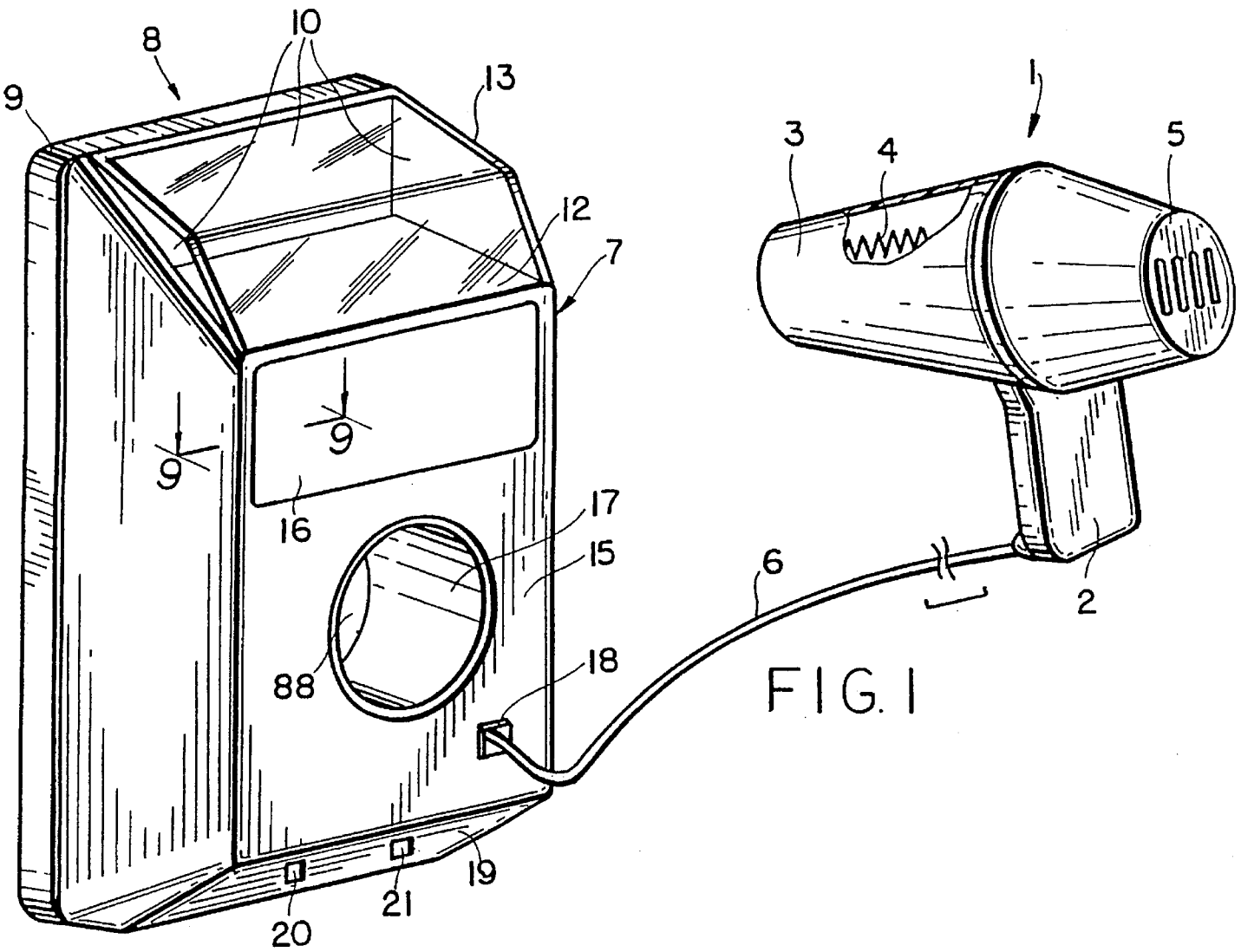
FIG. 1 is a perspective view of a first embodiment of hair dryer apparatus according to the invention.

FIG. 1 shows a first embodiment of hair drying apparatus according to the invention comprising a hand-held hair dryer 1 having a gripping handle 2 and a nozzle 3 for discharging heated air from the dryer 1. A heating element 4 is contained within the dryer 1 for heating the air. As is conventional, a motor (not shown) is contained within the dryer 1 for driving a fan in rotation to produce a flow of air from inlet slots 5 to and through the nozzle 3. An electrical cable 6 connects the dryer motor and heater 4 to an electrical supply means within a housing 7. The housing 7 is secured to a wall 8 or other rigid and secure support surface by detachably connecting the housing 7 to a base 9 fixed to the wall. The housing 7 is made of a plastic material. The top of housing 7 is formed with upstanding walls 10 partially enclosing a space 11 with a flat bottom or shelf 12. Various articles which are normally found in the bathroom, such as razors, toothbrushes, or the like can be placed on shelf 12 within space 11. A cover 13 is hinged at the back wall of the housing 7 for closing the space 11. The cover 13 can be made of transparent material. At the left, front, portion of the shelf 12 is a hole 14 in which a special tool can be inserted to lock and unlock selected modules in the housing in a manner to be explained more fully later. At the top of a front wall 15 of housing 7 there is a cut-out 16 for insertion of a module, such as one of those shown in FIGS. 8A–8G and to be described more fully later. The cut-out 16 extends across substantially the entire width of wall 15 and normally is covered by the face plate of the module or by a detachable blank closure plate if no module is present in the cut-out.

Below the cut-out 16 is a recess or receptacle 17 for the insertion and support of the nozzle 3 of the dryer 1. The receptacle 17 is inclined downwardly within the housing to support the dryer with stability. The electrical cable 6 is retractable into the housing 7 through an opening 18. The bottom wall 19 of the housing 7 slopes downwardly towards the back and test and reset switches 20 and 21 respectively of a ground fault circuit interrupter (GFCI) project at the face of wall 19.

Figure 2:
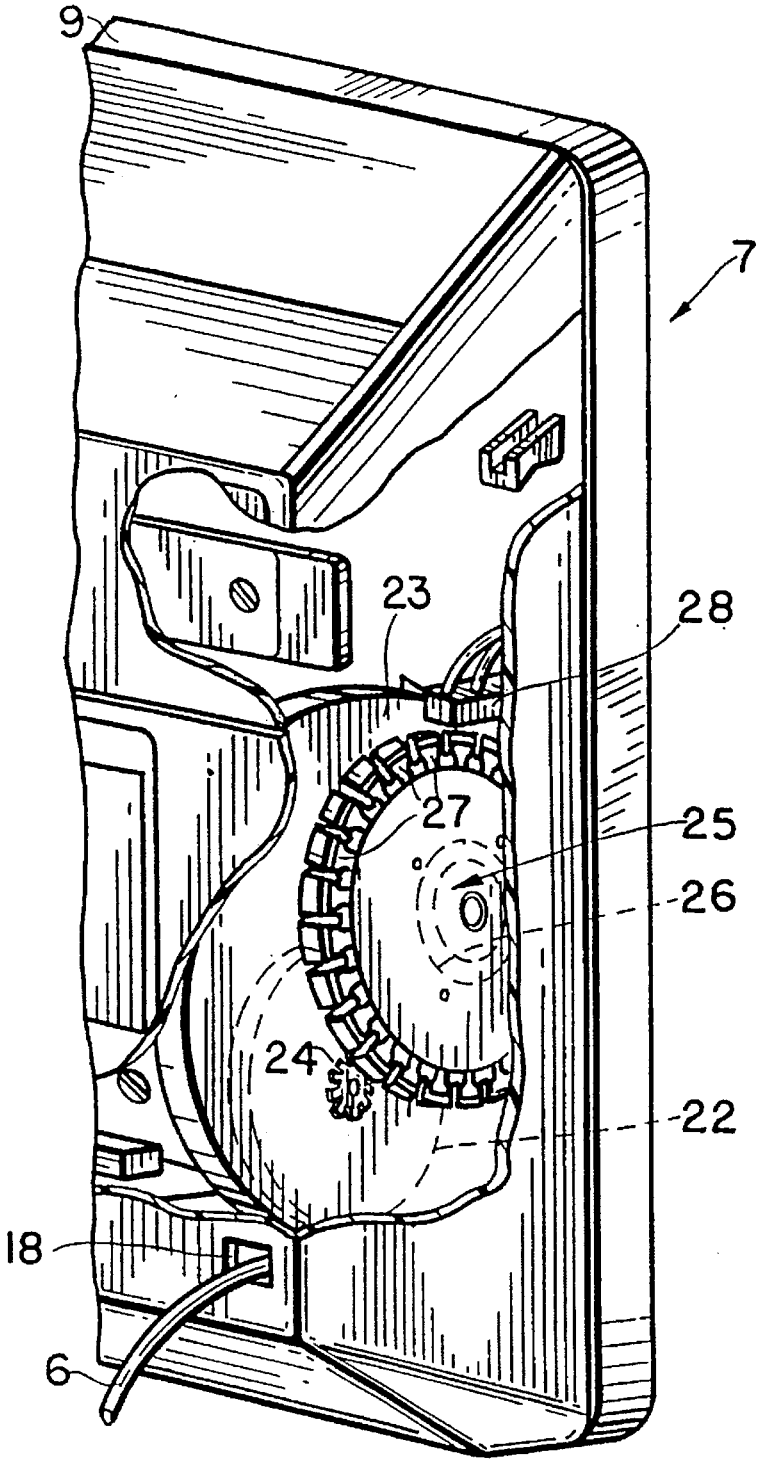
FIG. 2 illustrates a portion of the embodiment in FIG. 1 partly broken away to show internal details.

FIG. 2 shows the housing 7 with a portion of the front wall 15 broken away to reveal within the housing 7 a rotatable reel 22 within a casing 23. The cable 6 is wound on reel 22 and is connected to a power supply. A reduction gear 24 is secured to reel 22 to rotate therewith. The reduction gear 24 rotatably drives a daisy wheel 25 supported by the casing 23. The gear arrangement is such that when the cable 6 is fully extended from the housing 7 and the hair dryer 1 is at its maximum reach from the housing, the daisy wheel will have undergone one rotation (360°) from the fully retracted position of the cable. A torsion spring 26 between the daisy wheel 25, and the casing 23 applies torsional moment to urge the daisy wheel to retract the cable 6. The daisy wheel 25 has a plurality of spokes with bendable nodules 27 at their ends spaced circumferentially around the daisy wheel. A microswitch 28 is mounted in the housing 7 proximate the path of travel of the nodules when the daisy wheel undergoes rotation. By manually bending the nodules upwardly (radially outwards), actuation of the microswitch 28 can be controlled as a function of the length of the cable 6 extended from the housing 7. In this way the microswitch 28 can be operated to control connection of the power supply to the dryer 1 only when the dryer has been extended in a preset range. Namely, depending on the particular nodules which are bent upwards, the power supply to the dryer can be activated beginning when the dryer 1 is extended the pre-set distance from the receptacle 17 and the power supply will be continued until it is disconnected when the dryer has been extended a distance beyond which the last upwardly bent nodule has passed the microswitch 28. Hence, the dryer 1 can be energized only when the dryer 1 is displaced, for example, a distance away from a sink up to a maximum limit of extension of the cable 6 from the dryer 1.

Figure 8A:
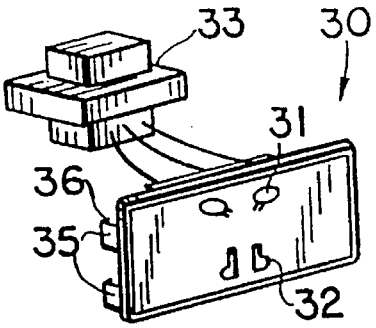
FIGS. 8A–8H illustrate various modules usable in the first and second embodiments of the invention.
Figure 9:
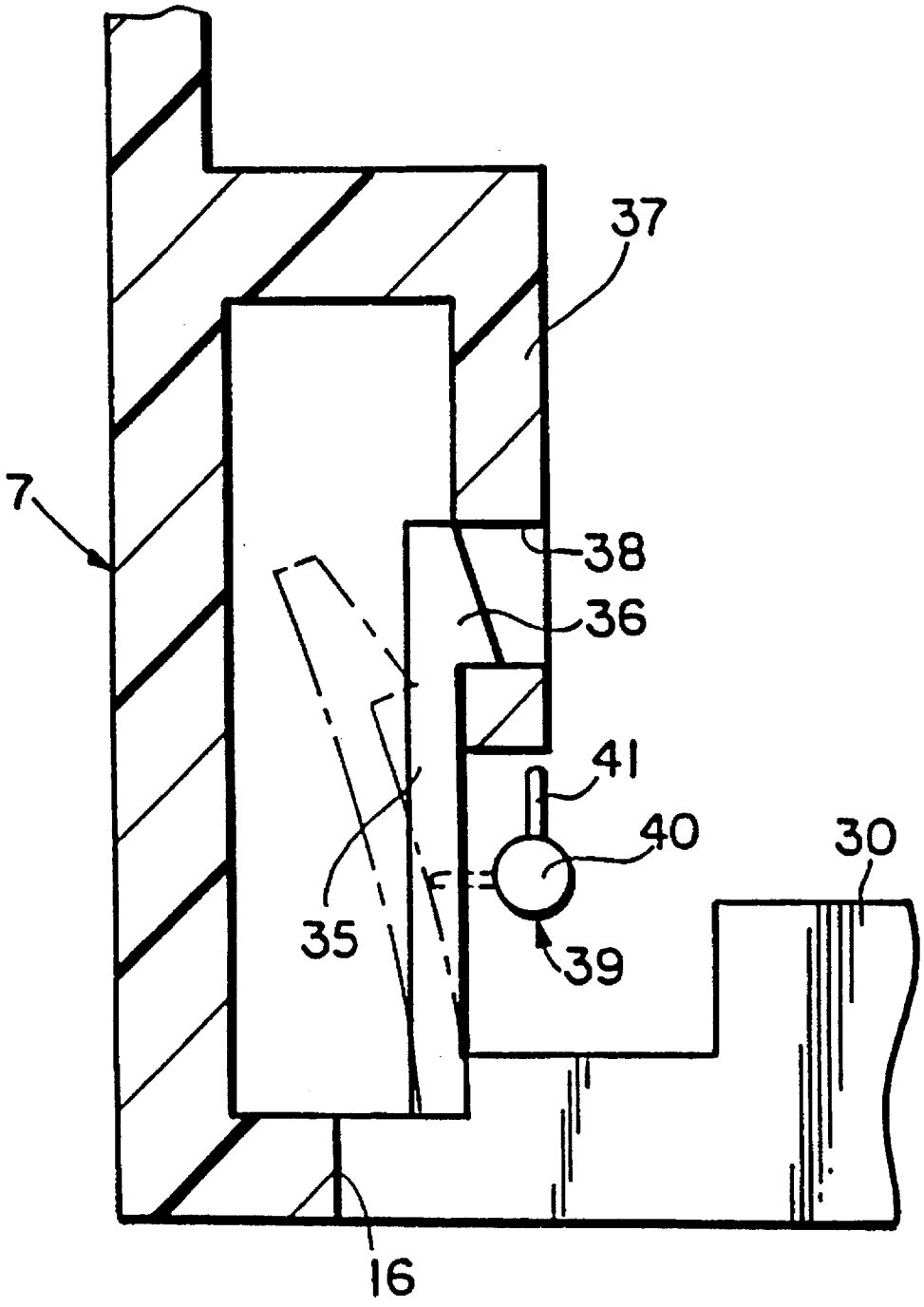
FIG. 9 is a sectional view taken on line 9—9 in FIG. 1.

FIG. 8A shows an embodiment of a shaver module 30 having shaver outlets 31 and 32 for supply of different voltages, e.g., 110 and 220 volts respectively. The shaver module 30 includes an isolation transformer 33 the function of which will be described later. In order to install the shaver module 30 in the housing 7 of the embodiment in FIG. 1, a closure plate for cut-out 16 is removed by unlatching the plate using a special tool inserted into the hole 14 and the module 30 is snap-fit in the cut-out 16 to securely hold the module in place in the housing 7. For this purpose, the module 30 includes flexible side tabs 35 with retaining lips 36 at their ends. The housing 7 is provided with rigid plugs 37 (FIG. 9) extending in a position adjacent to the position of the tabs 35 on each of the modules. The plugs 37 are provided with slots 38 into which the lips 36 snap when the module is inserted into the cut out 16. The engagement of the lips 36 in the slots 38 is generally sufficient to support the weight of the module but if supplemental support is required a shelf (not shown) can be molded in the housing. When the module 30 is installed in the housing it is not removable except by operating a release mechanism 39 controlled by the tool inserted into the hole 14. The release mechanism 39 comprises a turnable shaft 40 supported in the housing 7 and rotated by turning the tool in the hole 14. Fixedly mounted on the shaft 40 are fingers 41 which act on the tabs 35 when the shaft 40 is turned to deflect the tabs 35 and release the lips 36 from the slots 38, as shown in dotted outline in FIG. 9, thereby allowing removal of the module from the cut-out. All of the modules are constructed in the same way so that the modules are interchangeable in the cut-out. The modules all have electrical contacts (not shown) which connect the module in an electric circuit when the module is snap-fit in the cut-out. For this purpose conventional slide contacts can be used.

Figure 8C:
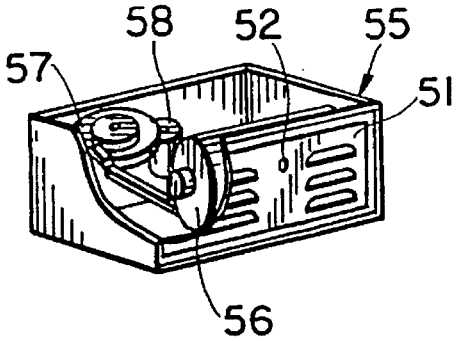
Figure 8B:
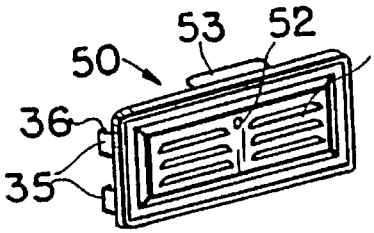

FIG. 8B shows a module 50 which functions as an air freshener. The module 50 has a grill 51 with louvre slots in its front face through which scented air can be discharged. The module 50 incorporates an infra red detector 52 capable of detecting human presence by virtue of heat and motion. The infrared detector 52 is connected to a 12 volt dc motor 53 which drives a fan (not shown) which forces air over a scented pad (not shown) which is located in proximity to the grill 51. When activated, the fan forces air over the scented pad to discharge the scented air through the grill 51. A timer is contained in the motor circuit to prolong the operation of the motor and fan for a preset time after the human presence is no longer detected.

FIG. 8C shows another embodiment 55 of an air freshener which incorporates an aerosol canister 56 which is activated by the rotation of a geared cam 57 driven by an electric motor 58. When the canister is activated, the nozzle thereof is forced inwards to expel a short burst of scented fluid at suitable intervals. When the detector 52 no longer senses the presence of a human, a further burst of scented fluid is released by a timed continued operation of the motor.

Figure 8D:
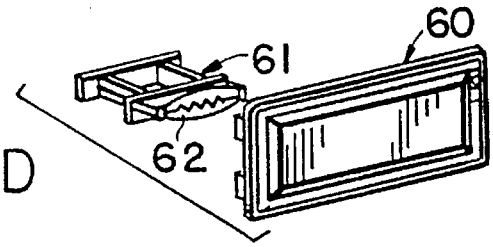

FIG. 8D shows a further embodiment of a module in the form of an illuminated panel 60. The panel 60 may contain advertising material or it can be blank. Additionally, the panel may be an illuminated mirror. The panel 60 is illuminated by a light illumination means 61 attached to the back of panel 60 so that a light emitting diode 62 of the light means 61 can illuminate the panel 60. The light means 61 is powered from the 12 volt dc supply of the electrical circuit when the module 60 is inserted into the cut-out 16 of the hair dryer apparatus. The illumination of the panel 60 is continuous and thereby also can serve as a night light.

Figure 8E:
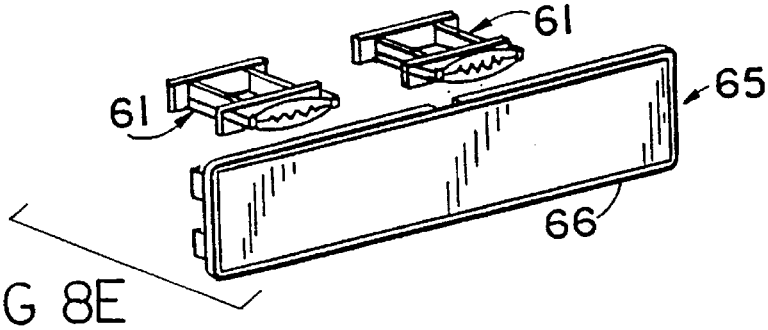

FIG. 8E is similar to FIG. 8D except that the module 65 illustrated therein is intended to be used in the embodiment of FIG. 3 (to be described later) and to extend over two cut-outs to enlarge the size of the illuminated panel 66 of module 65. In this embodiment two light sources 61 are provided to illuminate the enlarged panel 66.

Figure 3:
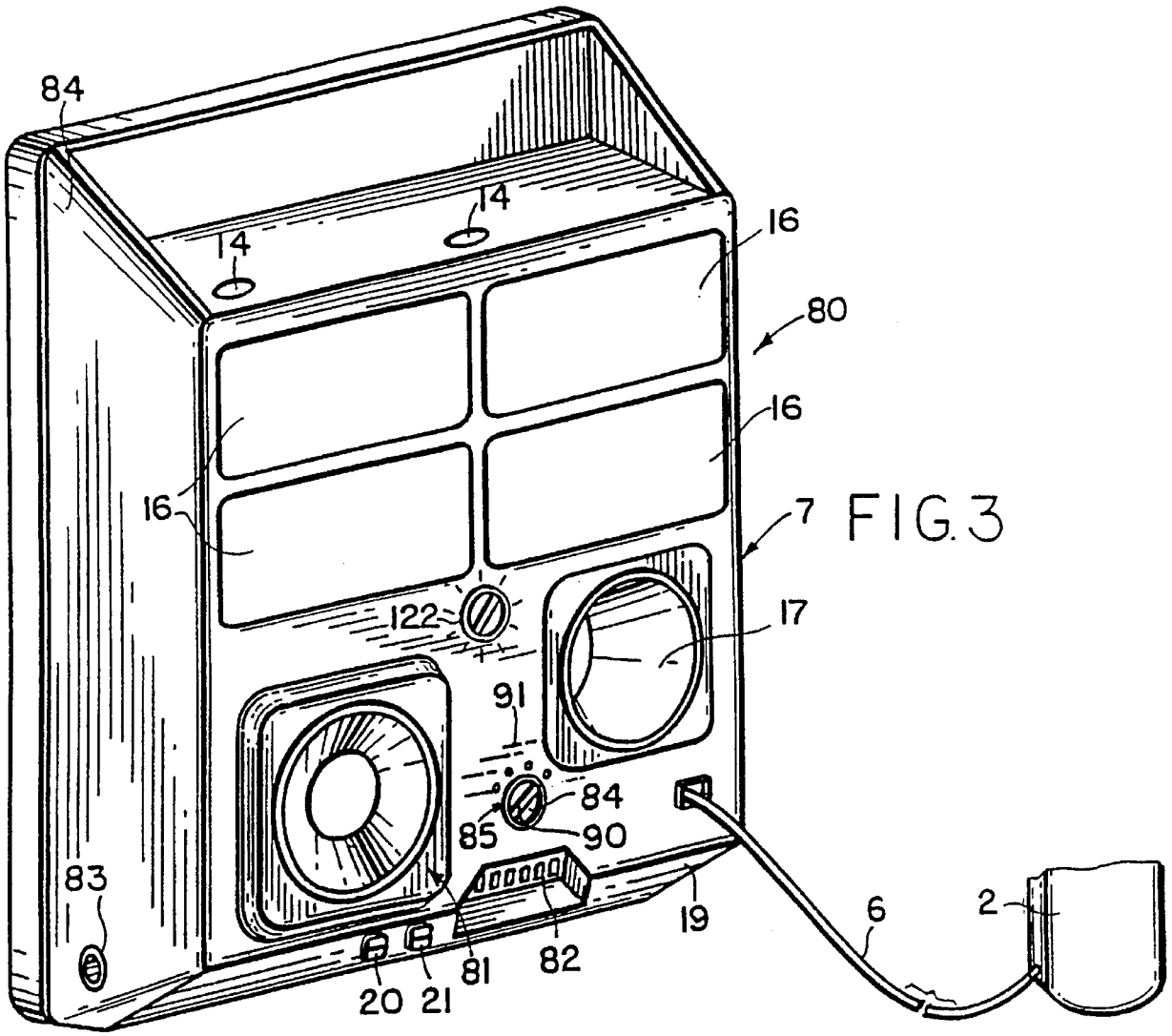
FIG. 3 is a perspective view of a second embodiment of hair dryer apparatus according to the invention.
Figure 8F:
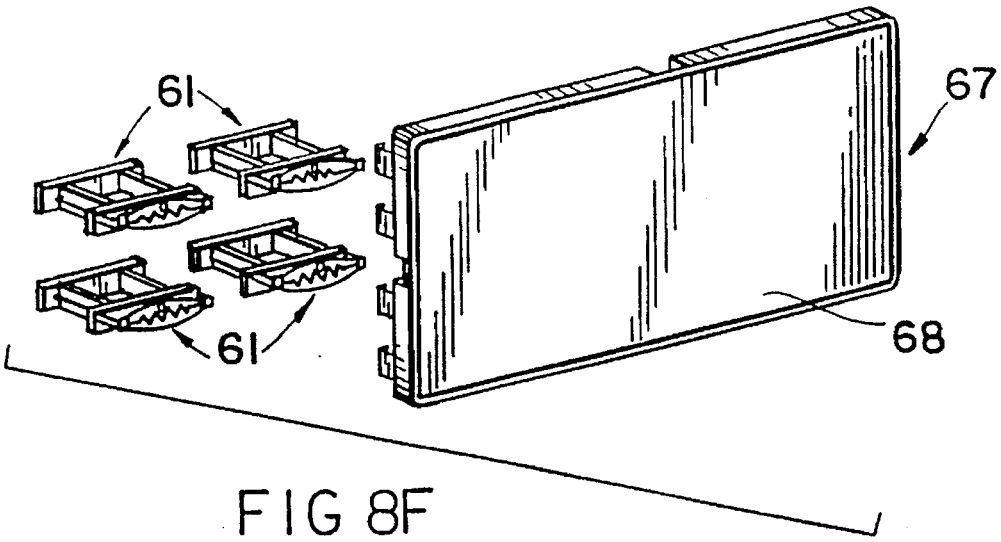

FIG. 8F shows another embodiment of a lighting panel 67 intended to cover four cut-outs in the embodiment of FIG. 3. The illuminated panel 68 therefore is four times the size of that in FIG. 8B and four lighting means 61 are employed, one for each cut-out.

Figure 8G:
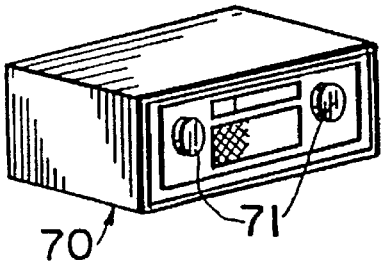

FIG. 8G illustrates a module 70 in the form of a radio having appropriate control dials 71 to select station and volume. In lieu of a radio, module 70 can be constructed as a television set.

Figure 8H:
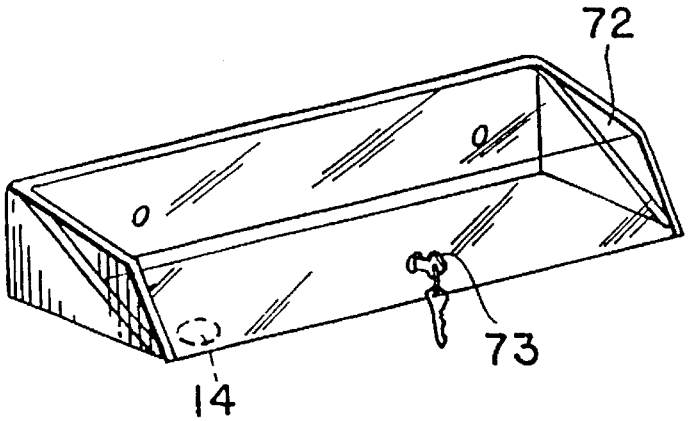

FIG. 8H shows a modification in which the lid 12 in FIG. 1 is replaced by a lockable lid 72 which is opened and closed by means of a key 73. In this way various amenities can be provided on shelf 12 within the space 11 at the top of the housing 7 and offered for sale in much the same manner as in mini-bars in hotels. This embodiment also has the advantage of keeping the hole 14 within the locked space. The lid 72 is made transparent in order to display the amenities which are offered for sale.

The embodiment 80 of FIG. 3 is similar to that of FIG. 1 with the exception that it has four cut-outs 16 for selectively receiving a multiple number of modules and additionally, it also includes a number of heated-air utilization means including a tumble dryer 81 whose construction and arrangement corresponds substantially to that in my earlier Patent 4,868,998, the details of which are incorporated by reference herein. Briefly, the tumble dryer 81 is rotatably supported within the housing 7' for being rotated by the heated air from the dryer 1 when the nozzle 3 of the hair dryer is placed within the receptacle 17. The heated air passes through the dryer 81 to heat articles placed therein whereby the articles are subjected to tumbling and heating concurrently. In effect the embodiment of FIG. 1 is combined with the tumble dryer in the embodiment of FIG. 3.

The housing 7' of the embodiment 80 has outlet openings 82 in the bottom wall 19 from which heated air can be discharged to dry nail polish and/or the hands of a user. The openings 82 can also be used to supply heat to the bathroom. An aperture 83 is provided in the side wall 84 of the housing 7' for supplying heated air to defog a mirror or the like.

In order to control the flow of the heated-air to the selected heated-air utilization means, a control means 84 having an external control switch 85 is provided. The control means 84 includes a rotatable drum 86 having an outlet slot 87 for discharge of heated air. The heated air from the dryer 1 flows through an opening 88 (FIG. 1 ) at the rear of the receptacle 17. The heated air flows into a manifold or channel 89 and then into the interior of the drum 86. The position of the drum determines which of the heated-air utilization means will receive the flow of heated air. The control switch 85 has a finger grip 90 for turning the drum 86 and the position of the finger grip 90 indicates the heated-air utilization means which is being supplied with heated air. Indicia 91 on the housing 7' indicate to the user the particular selected heated-air utilization means which receives the heated air.

FIGS. 5 and 6A–6D show the positions of the control drum 86 and the different patterns of flow of the heated air produced thereby. The drum 86 is rotatably supported in a housing 92 having outlets 93, 94 and 95 respectively for conveying heated air to tumble dryer 81, nail and/or hand dryer outlets 82 and defogger outlet 83. Depending upon the position of the drum 86 the heated air will be selectively diverted to the various heated-air utilization means. In the position shown in FIG. 6A the drum 86 is oriented so that the slot 87 coincides with the outlet 94 so that all of the heated air is supplied to outlets 82 which provide for drying the hands of a user with maximum air flow. The air flow from outlets 82 can also be used to heat the bathroom.

Figure 6B:
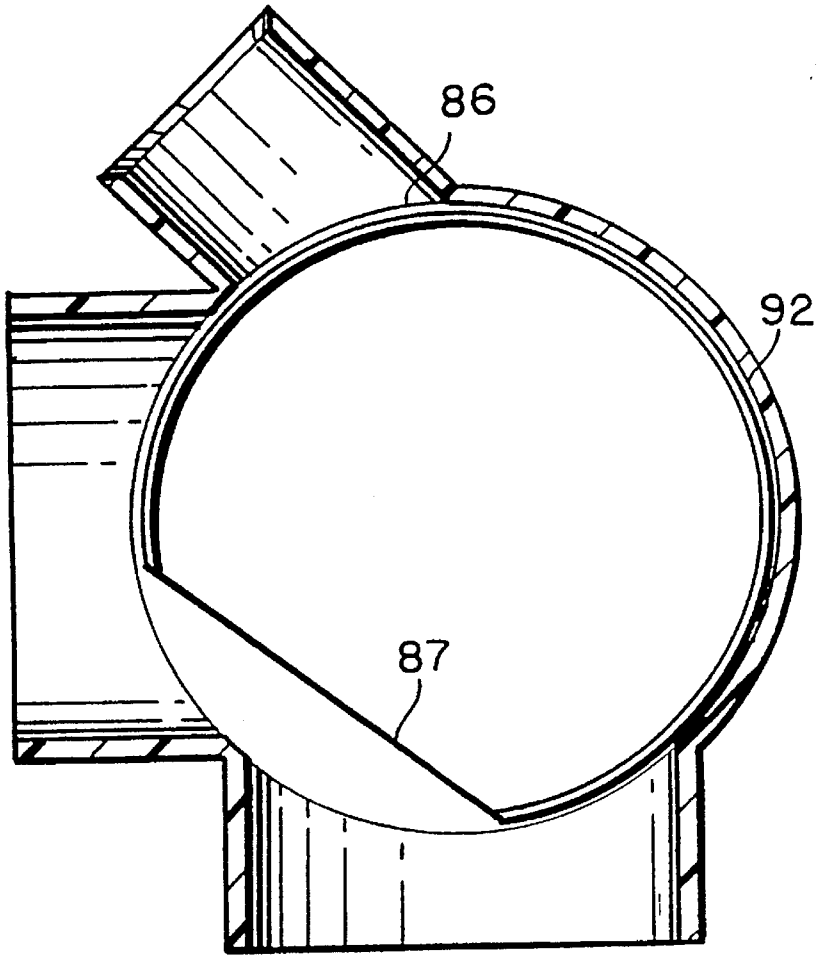
FIGS. 6A–6D illustrate different positions of a control means in the embodiment of FIG. 3 for air flow control.
Figure 6A:
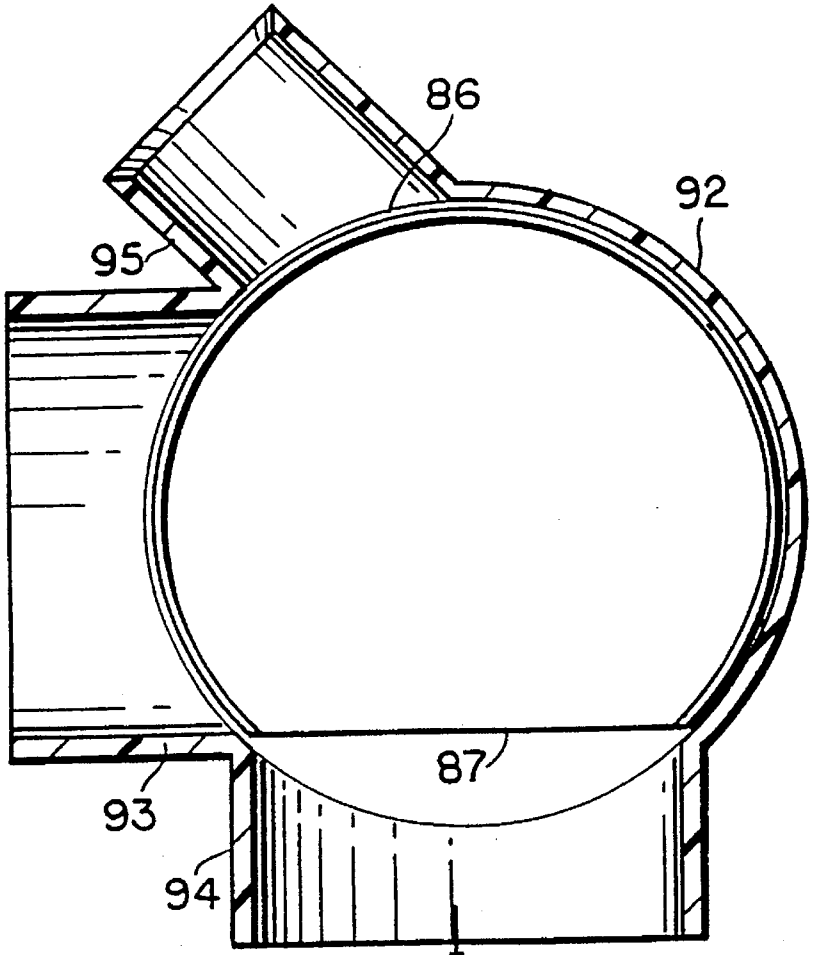

In FIG. 6B the drum 86 is oriented so that the slot 87 supplies less heated air to the outlets 82. In this position the reduced flow of heated air to the outlets 82 is suitable for a nail drying function.

Figure 6D:
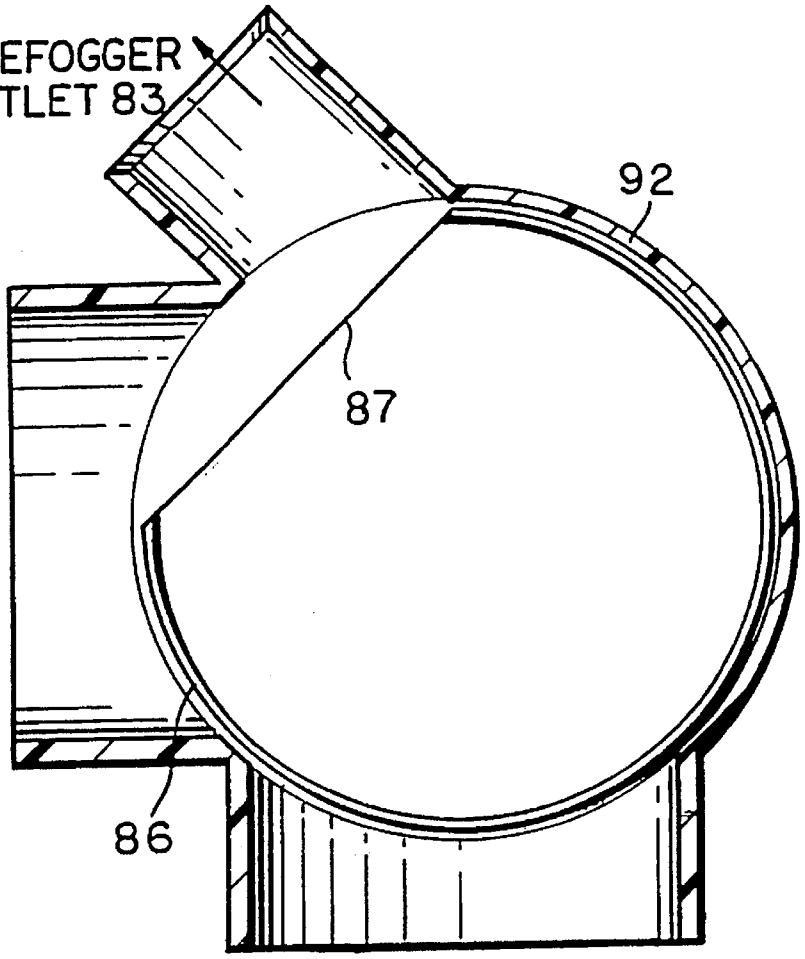
Figure 6C:
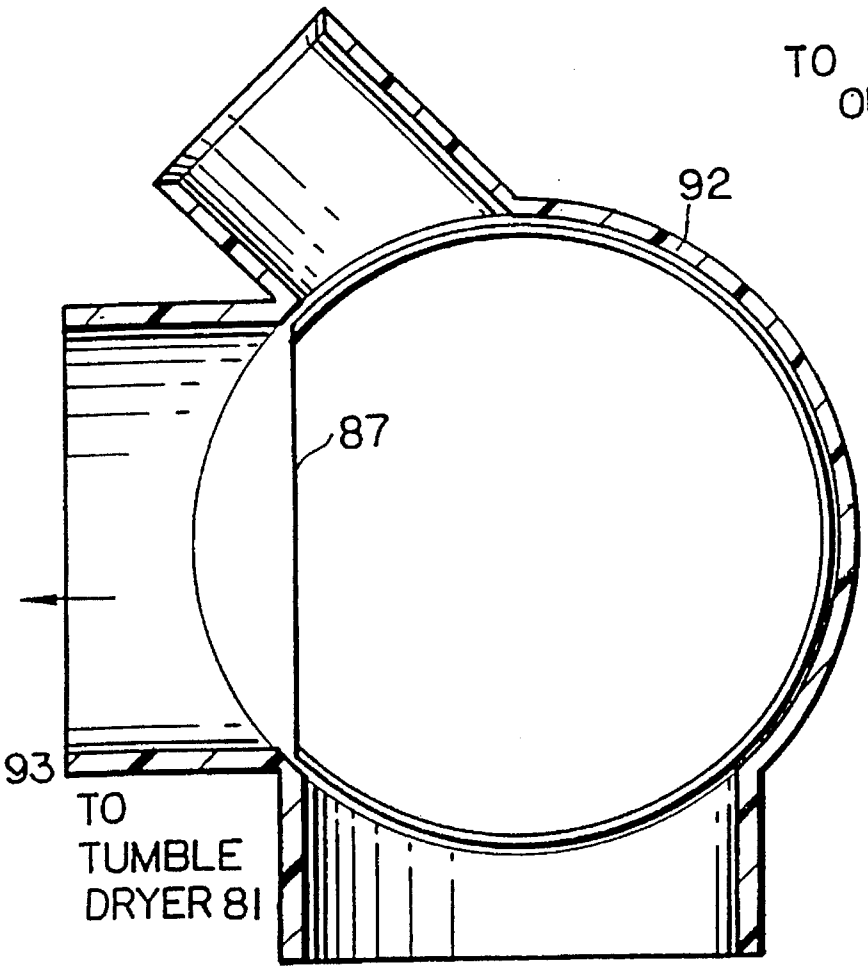

FIG. 6C shows the drum 86 in a position in which the outlet 87 coincides with the outlet 93 so that the entire amount of heated air flows to the tumble dryer 81.

In FIG. 6D the position of the drum 86 is such that the outlet 87 supplies heated air to the defogger outlet 83.

Figure 5:
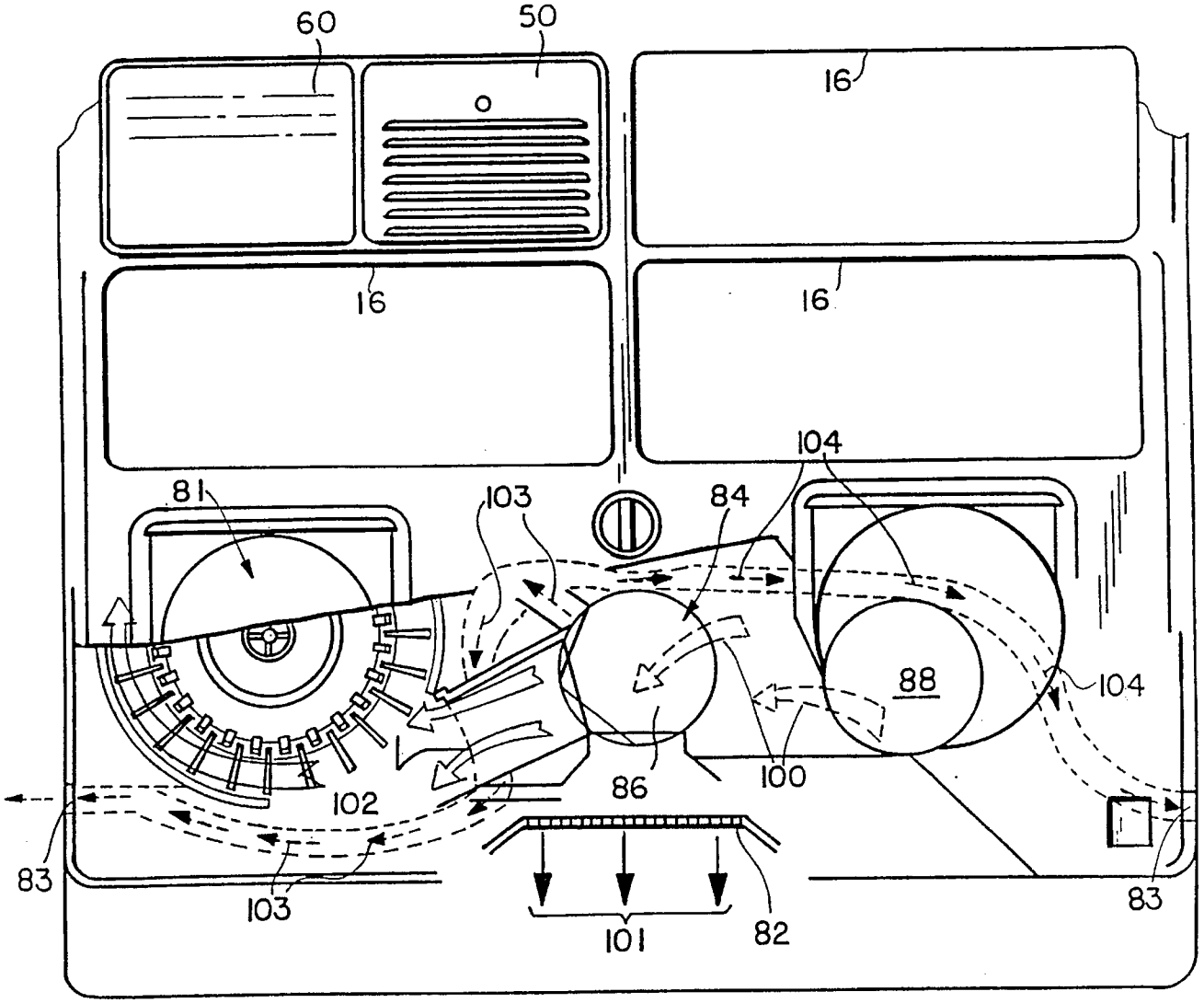
FIG. 5 is a diagrammatic illustration of heated air flow paths in the embodiment of FIG. 3.

The various patterns of flow of heated air are illustrated in FIG. 5. Therein, the incoming heated air from the dryer 1 is shown at 100 and the heated air flows into the drum 86 through the channel 89. Depending on the position of the drum 86 the heated air can be supplied to outlets 82 along flow path 101, to the tumble dryer 81 along flow path 102 or to the defogger outlet along path 103. In the embodiment illustrated in FIG. 5 there is a second defogger outlet 83 provided at the right side of the housing 7' for outflow of a second part 104 of the defogger outlet air. In order to utilize the defogger air, a tube (not shown) is connected to the outlet 83 and affixed onto or adjacent to a mirror to be defogged. The tube contains a slit therein extending substantially the entire width of the mirror and the tube is sealed at its remote end so that when defogger air is supplied to the tube, the defogger air will "wash" the mirror to prevent fogging thereof.

Figure 7A:
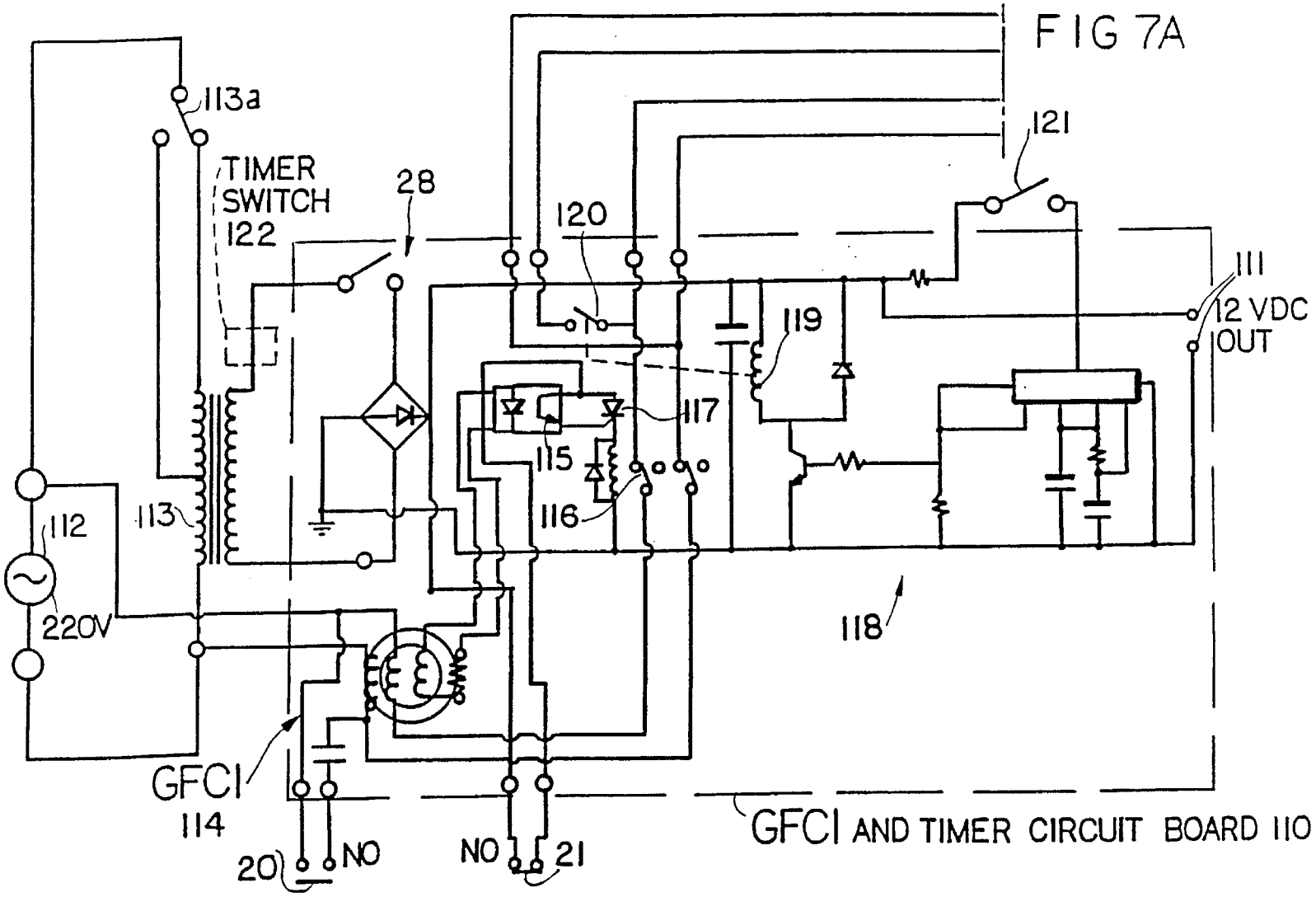
FIG. 7 is a circuit diagram of circuit means in the embodiment of FIG. 3.
Figure 7B:
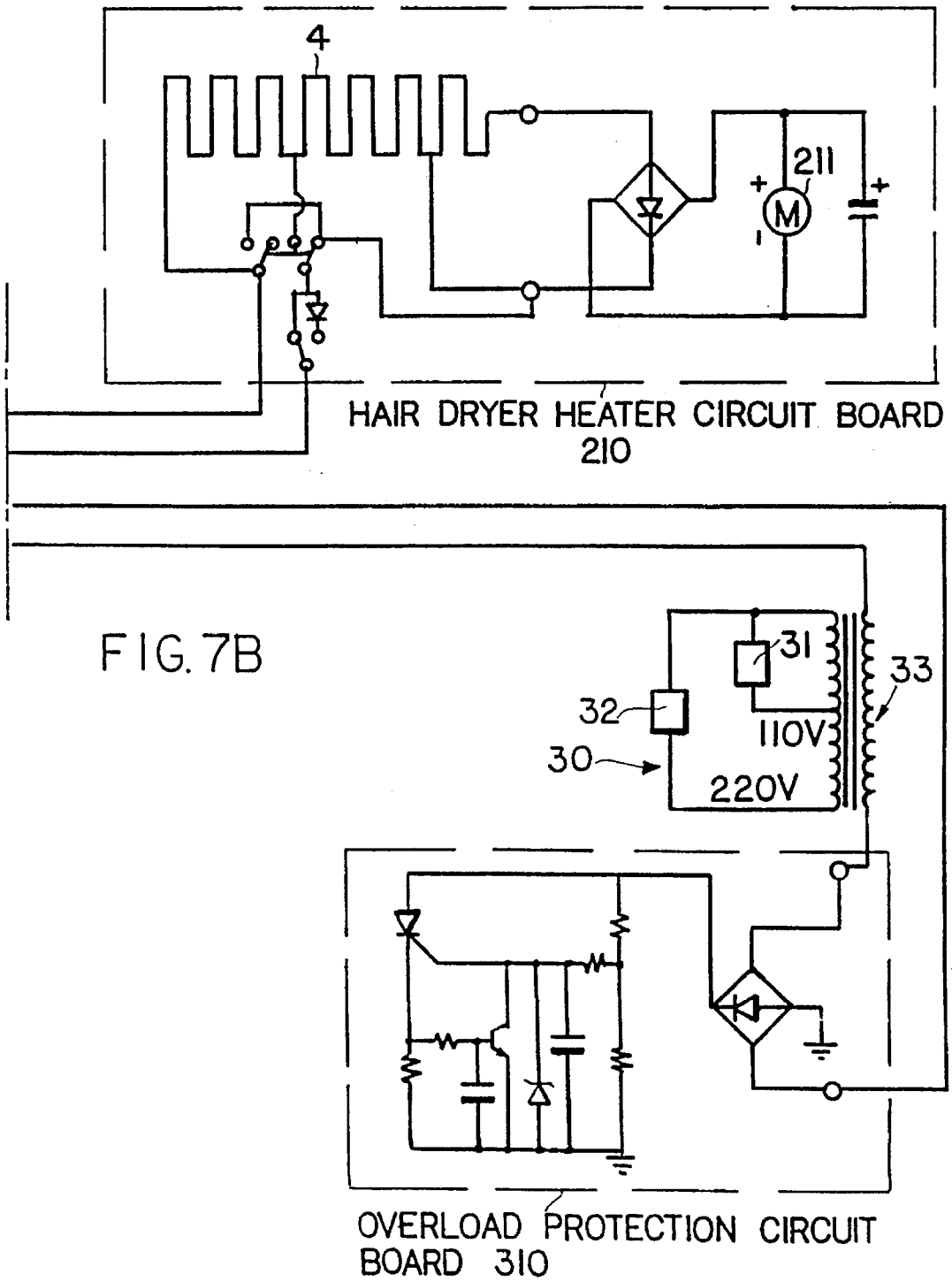

FIG. 7 is a circuit diagram of the embodiment shown in FIG. 3 with the shaver module 30 connected in the circuit. The circuit comprises a number of circuit elements mounted on respective circuit boards which are replaceable in the event that one of the circuit elements becomes inoperative. The circuit boards include a GFCI and timer circuit board 110, a hair dryer, heater circuit board 210 and an overload protection circuit board 310. The GFCI and timer circuit board 110 is contained within the housing 7'. The circuit 110 has output terminals 111 supplying 12 volts d.c. for power supply to each of the modules when it is inserted into the respective cut-out in the housing. The hair dryer heater circuit board 210 is connected to the GFCI and timer circuit board 110 for supply of power to the heater element 4 and the blower motor 211 of the hair dryer 1. The overload protection circuit 310 is associated with the shaver socket module 30. Connected to the circuit board 310 is the isolation transformer 33 which supplies voltage to the socket 31 for 110 volts and the socket 32 for 220 volts.

The circuit 110 is connected to the power supply 112 which is 220 volts. The power supply 112 is connected to a transformer 113 through a voltage selector switch **113*a*. Connected to both legs of the power supply 112 is a GFCI 114 which monitors any difference in magnitude of the current in both legs of the power supply at all times. If a difference exists of the order of as low as 20 mA the GFCI operates an opto-isolator LED 115 which in turn operates a double pole double throw relay 116 via a silicon controlled rectifier 117. Although the description is given for a GFCI which is itself well known in the art, other equivalent safety devices can be used such as mechanical flux balance arrangements or grounded neutral detector devices. The illustrated embodiment is a typical example whose circuit can differ greatly. The relay 116 isolates both the isolation transformer 33 of the shaver socket module and the hair dryer heater circuit from the power supply when the GFCI 114 is activated. Once the relay is activated by the silicon controlled rectifier, it is maintained in the active position to disconnect the heater circuit and shaver socket module. The silicon controlled rectifier "latches" and requires manual resetting by reset switch 21. The test switch 20 when operated manually simulates a fault and checks the correct operation of the GFCI. Included in the circuit 110 is a timer circuit 118 which incorporates a relay 119 operating a switch 120 for controlling the time of operation of the dryer after activation. The relay 119 and switch 120 can be integrated as a solid state switch. Also connected in the power supply to the dryer is the switch 28 which operates in accordance with the setting of the nodules on the daisy wheel in response to the degree of extension of the power cable 6 from the housing 7. The timer circuit 118 which operates the relay 119 is reset when the hair dryer 1 is replaced in its receptacle 17 and the electrical cable 6 has been retracted into the unit. In order to activate the timer circuit 118 a microswitch 121 is placed in the circuit, the switch 121 being controlled by the insertion and removal of the nozzle of the hair dryer in the receptacle 17** in the housing.

As evident from the above, there are three levels of electrical protection provided by the circuit. The first level of electrical protection is the inclusion of the GFCI, the second is in the operation of the hair dryer on/off function due to the winding and unwinding of the electrical cable 6 and the third is in the timer circuit which will interrupt the power to the hair dryer after a suitable period of time of operation. The isolation transformer 33 is an additional level of protection associated with the shaver module.

The switch **113*a* for selecting the voltage to be supplied to the unit is placed in the housing and is initially operated when the housing is installed on the base 9**.

A mechanical timer switch 122 can optionally be incorporated into the circuit in order to start the operation and the elapsed time of the entire circuit.

Figure 10:
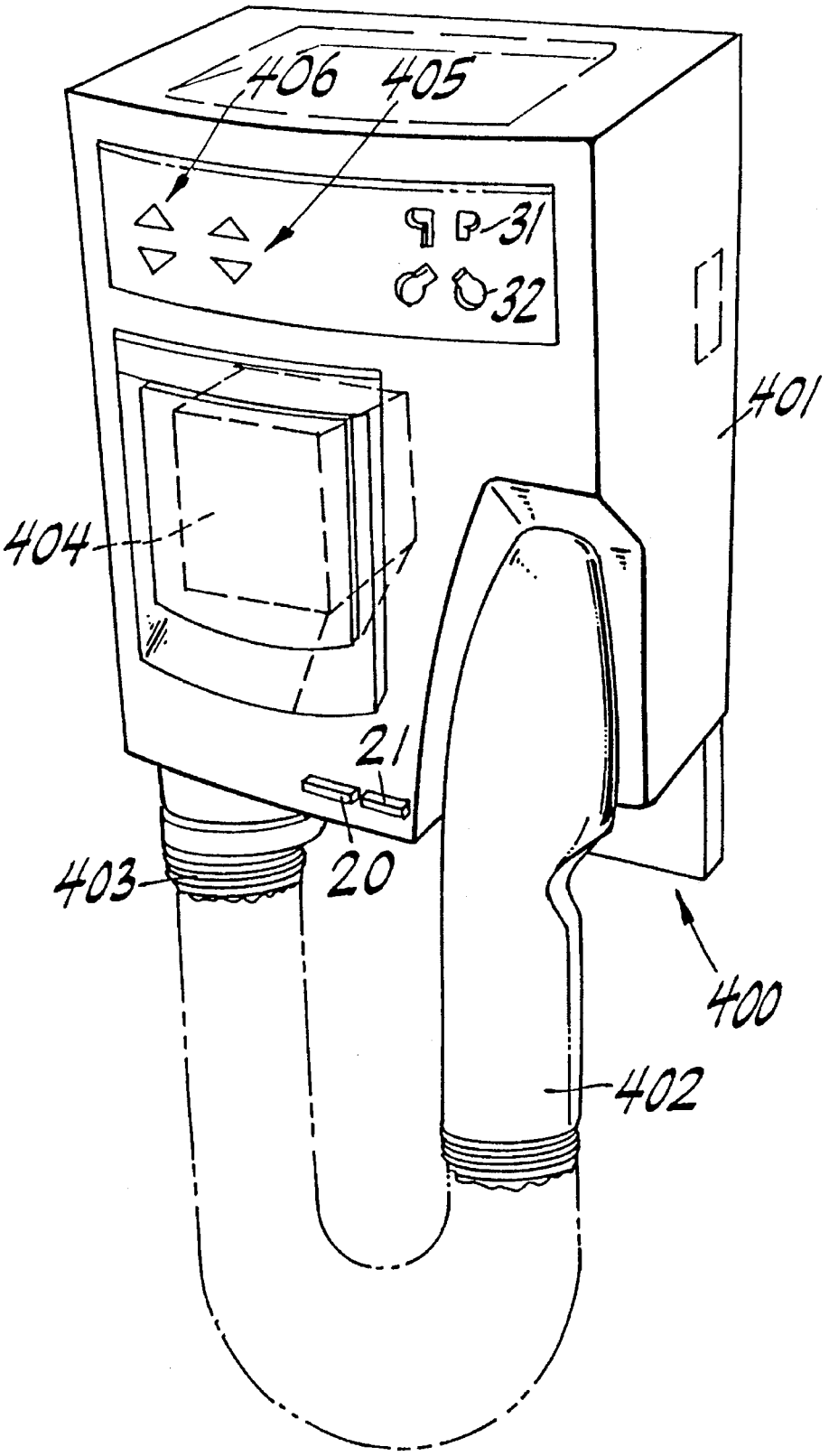
FIG. 10 is a front perspective view of another embodiment of the hair dryer according to the invention.

FIG. 10 illustrates another embodiment of the hair dryer 400 which comprises a housing 401 attached to the wall in the same manner as explained with reference to the embodiment of FIG. 1. The dryer 400 includes a handle 402 connected to the housing 401 by a flexible hose 403. Disposed within the housing 401, is an assembly 404 of a motor and a heater whose function is the same as fan motor 5 and heater 4 in the embodiment of FIG. 1, namely to supply heated air for hair drying purposes. In use, the handle 402 is removed from its receptacle in the housing 401 to direct the heated air onto the hair of the user. The circuit boards of the electrical circuit described in connection with FIG. 7 are incorporated into the housing 401 and illustrated at the front of housing 401 are outlets of socket 31 for 110 volts and outlets of socket 32 for 220 volts. The test button 20 and reset button 21 for the GFCI are located at the front of the housing 401. Switches 405 for increasing and decreasing the speed of the fan motor and switches 406 for increasing and decreasing the temperature of the heater are disposed at the front face of the housing.

Figure 11:
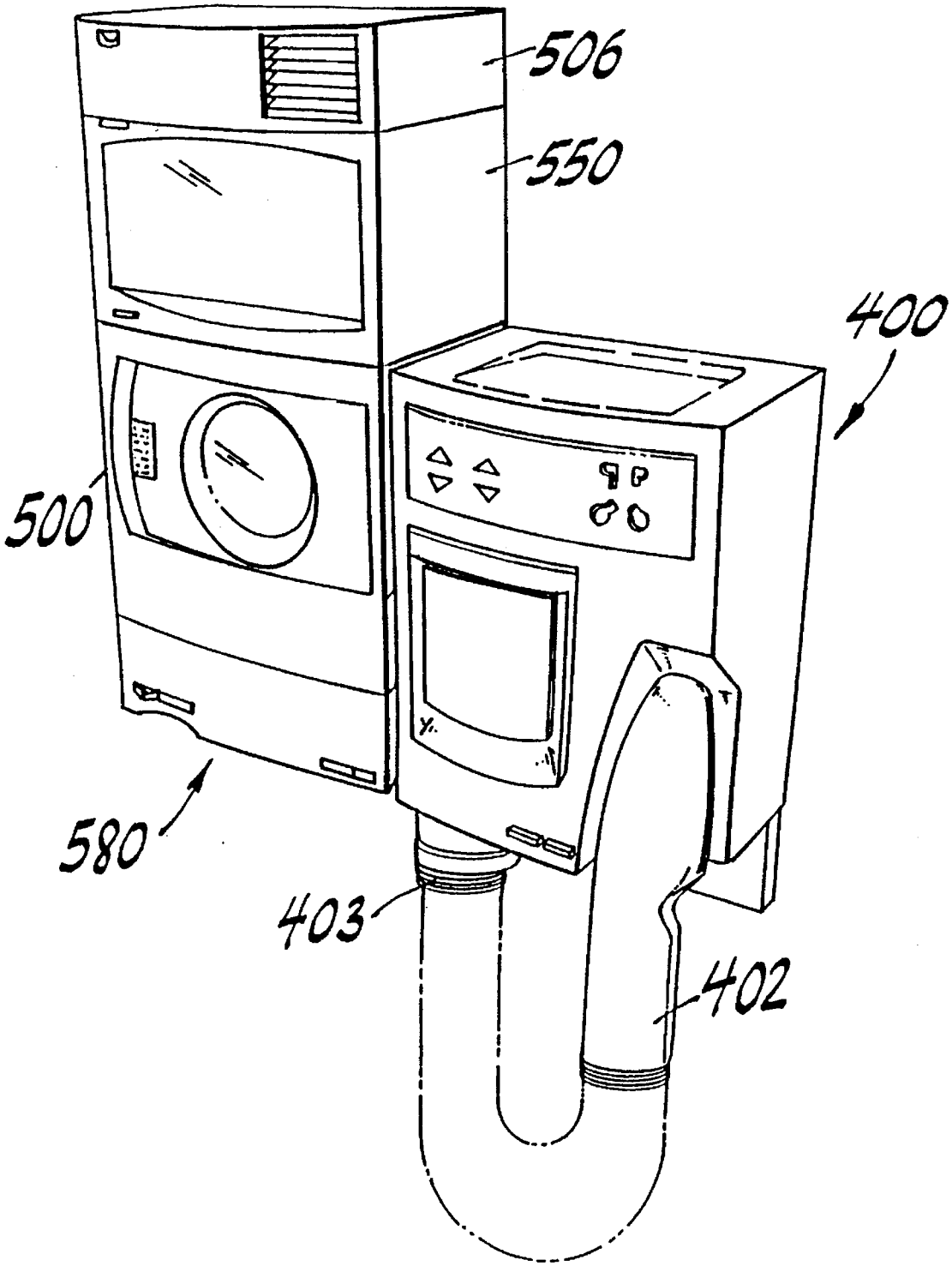
FIG. 11 shows the hair dryer of FIG. 10 connected to selected accessory modules.

The hair dryer 400 can serve as a base unit for connection thereto of a number of accessory modules or units as shown in FIG. 11. Therein is seen the hair dryer 400 to which are connected a garment dryer 500, an illuminated vanity mirror unit 550, and a room deodorizer 560. The accessory units are electrically connected to the base unit (hair dryer 400) to derive electrical power therefrom when the accessory units are connected to the base unit or to one another.

Figure 12:
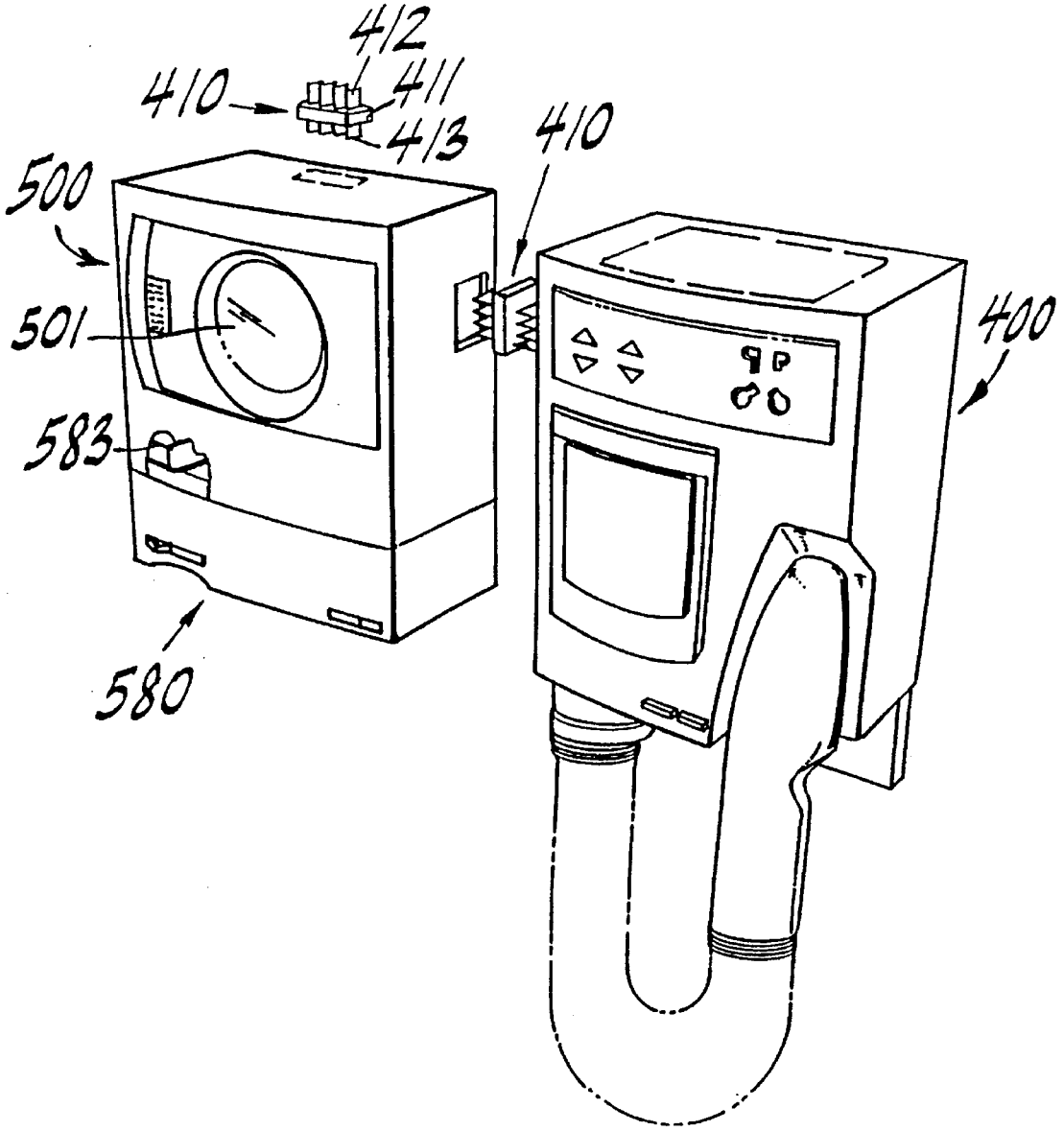
FIG. 12 is an exploded view of the hair dryer of FIG. 11 and one accessory module connected thereto.
Figure 13:
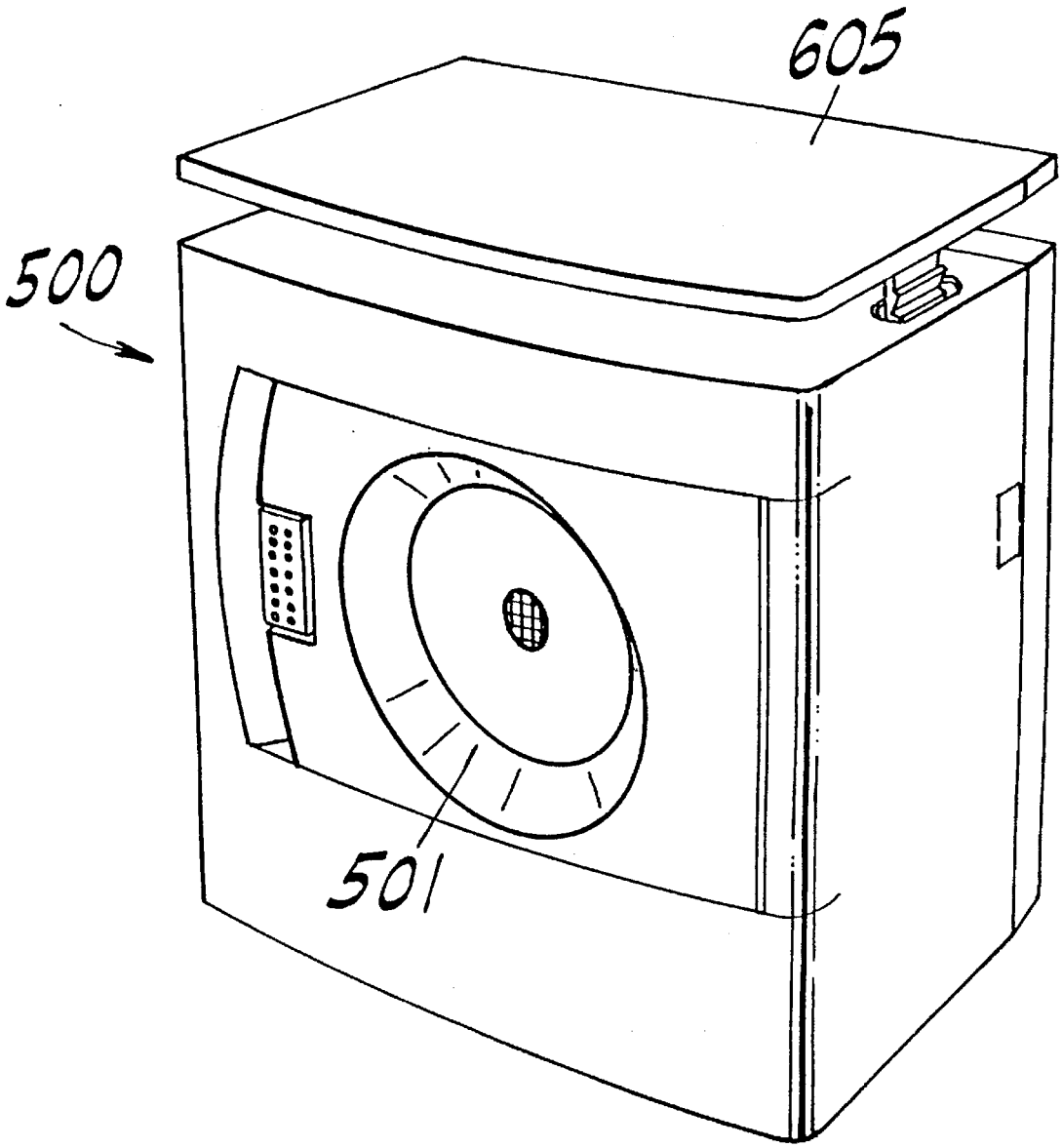
FIG. 13 is a front perspective view of another embodiment of a garment dryer.
Figure 22:
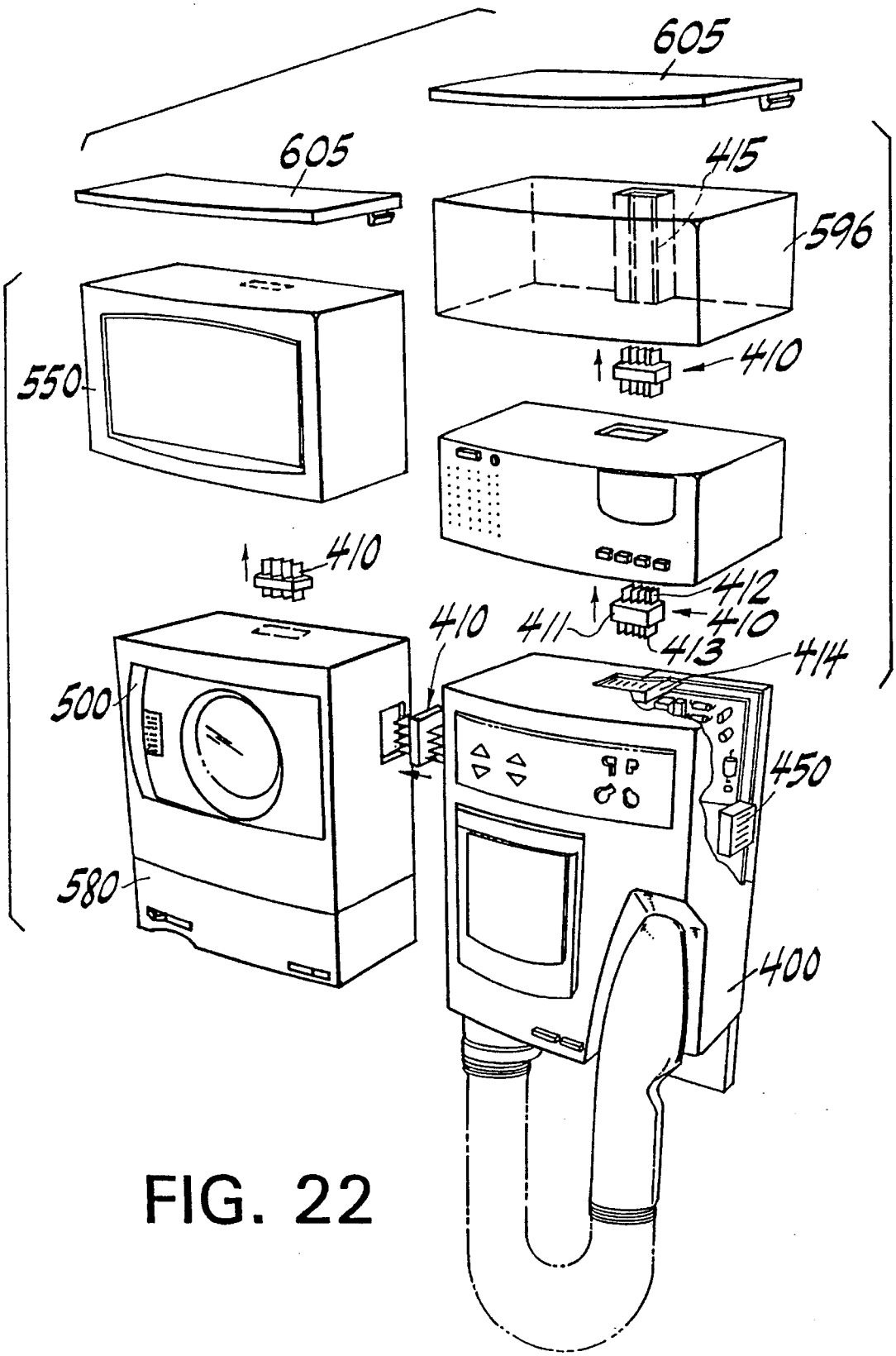
FIG. 22 is an exploded view of another assembly of modules to illustrate the electrical interconnection therebetween.

This is illustrated diagrammatically in FIG. 12 by the provision of electrical connector 410 which establishes electrical connection when the units are connected together. Referring additionally to FIG. 22, each electrical connector 410 has an electrically insulated body 411 with two sets of contacts 412, 413 projecting at opposite sides of the body 411. In a modification the contacts 412, 413 can be male and female contacts. One set of contacts 413 is fitted in a socket 414 in one unit (dryer 400) to establish electrical connection therewith while the other set of contacts 412 is fitted in the socket in the other unit (module 595) to establish electrical contact therewith thereby establishing electrical connection between the units 400 and 595. Electrical connection between the sockets of each unit is established by electrical lines 415 in the unit.

Figure 14:
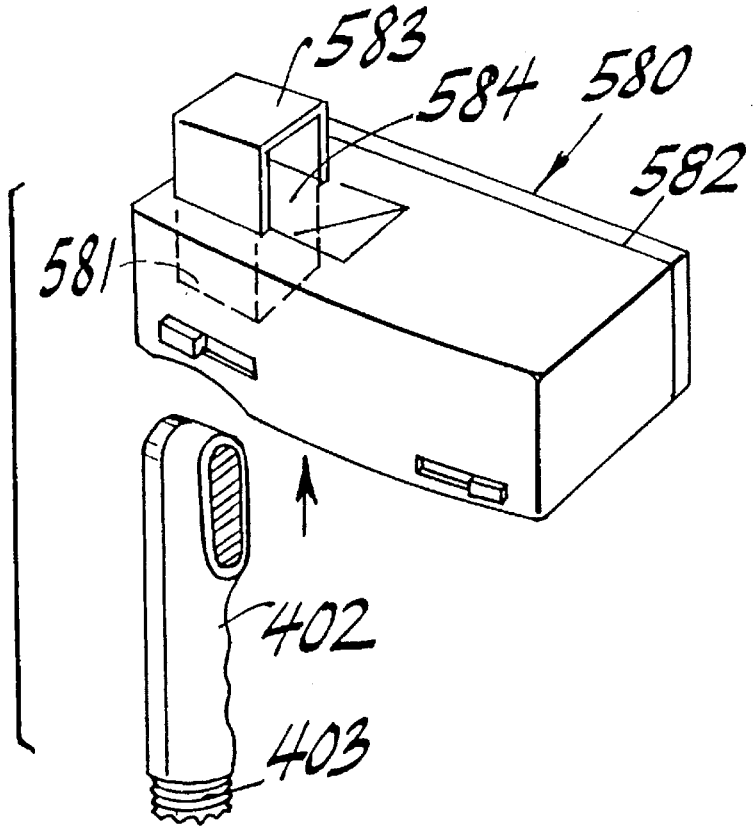
FIG. 14 is a perspective view of an adaptor unit intended for attachment to the bottom of the garment dryer of FIG. 13.

Also illustrated in FIGS. 11 and 12 is an adaptor unit 580 which attaches to the bottom of the garment dryer 500 for receiving the handle 402 of the hair dryer for supplying heated air to the garment dryer. The garment dryer 500 basically has the same construction described earlier and is not repeated hereat except to note the transparent door 501. The adaptor unit 580 has a recess or receptacle 581 (FIG. 14) similar to receptacle 17 in the previous embodiments, for receiving the handle 402. Different adaptor units with difference size and shape receptacles can be provided to correspond to the size and shape of the handle 402 of the hair dryer. Alternatively, the adaptor unit can be constructed to receive different receptacles having different sizes and shapes of openings corresponding to different handles 402. A securing means (not shown) at the bottom of the adaptor unit 580 is provided to hold the handle in an upright condition. For example, a friction ring can encircle the receptacle to frictionally hold the handle 402 in the receptacle.

At the top of the adaptor unit 580 is a detachable director plate 582 on which is provided an air deflector hood 583. A manifold 584 is formed within the adaptor unit 580 and extends from the opening 581 to and through the hood 583 so that heated air discharged from the handle 402 will be conveyed and discharged from the hood 583. The hood 583 projects into the garment dryer 500 when the adaptor unit 580 attached to the bottom of the garment dryer to supply heated air to the garment dryer in substantially the same manner as described in the embodiments of FIGS. 1 and 3 and therefore is not repeated hereat.

Figure 15:
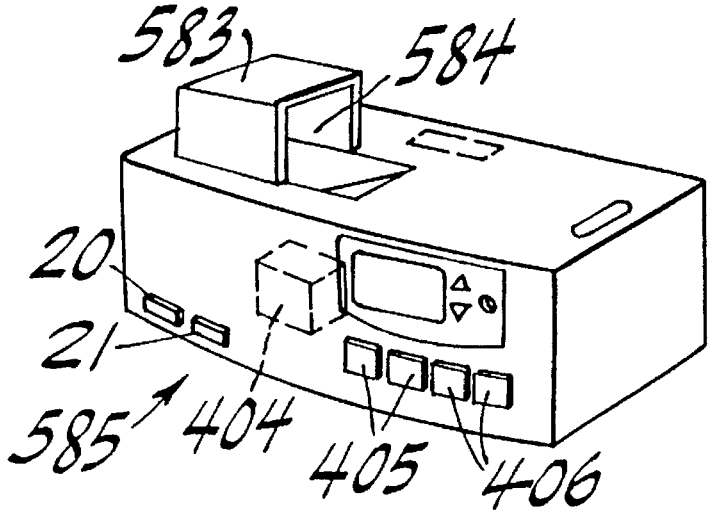
FIG. 15 illustrates a power unit attachable to the bottom of the garment dryer.

Instead of supplying heated air to the garment dryer from the hair dryer, it is also possible to omit the hair dryer and to utilize a power unit 585 as shown in FIG. 15. The power unit 585 is similar in construction to the adaptor unit 580 and attaches to the bottom of the garment dryer 500 in the same manner. However, instead of being supplied with heated air from the hair dryer as in the case of the adaptor unit, the power unit contains the assembly 404 of the fan and heater. The circuit boards of the electric power supply means are contained in the power unit. When assembly 404 in the power unit is electrically energized, the fan and heater at the assembly produce heated air which is supplied to the manifold 584 and then into the interior of the garment dryer 500 as in the case of the adaptor unit 580. At the front of the power unit 585 are the test and reset switches 0,21 of the GFCI and fan and temperature control switches 405,406. The bottom of the power unit 585 is a solid closed plate.

Figure 16:
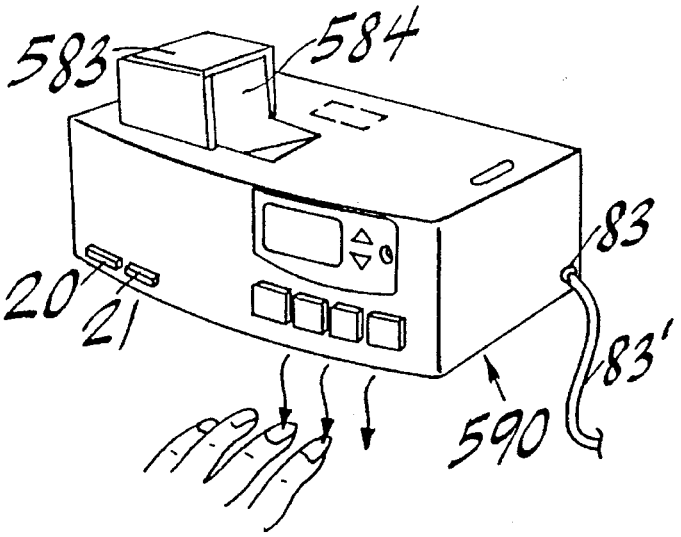
FIG. 16 is a modified embodiment of the power unit of FIG. 15.

FIG. 16 illustrates a power unit 590 according to a modified embodiment. The power unit 590 is provided with openings in the bottom wall corresponding to the openings 82 shown in FIG. 5 for discharge of heated air for drying nail polish and/or the hands of a user. The power unit 590 also includes an outlet 83 for supplying heated air to a tube 83' which has a terminal end with apertures for supplying the heated air to a mirror to defog the mirror.

Figure 17:
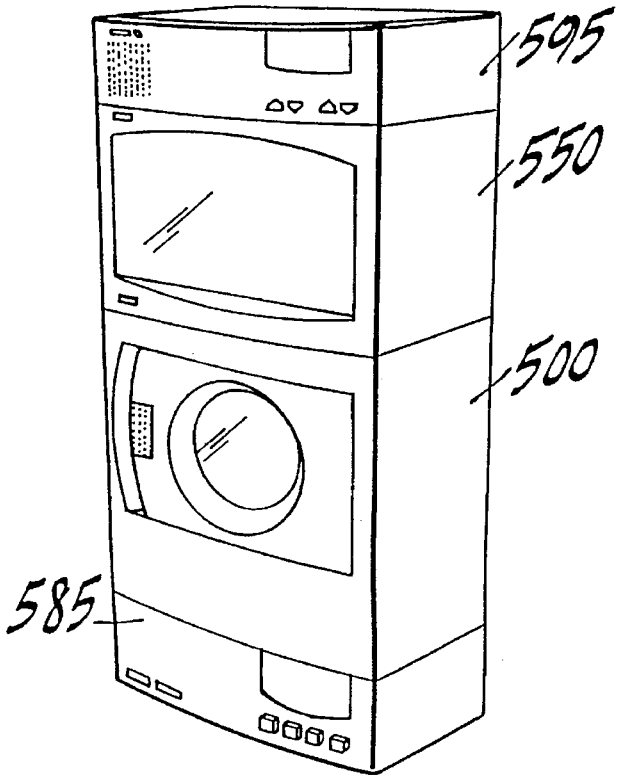
FIG. 17 shows an assembly of the power unit and the garment dryer in combination with additional accessory modules.

FIG. 17 shows a single stack of modules in which the power unit 585 is connected to the bottom of the garment dryer 500 at the top of which are successively connected an accessory unit 550 having an illuminated vanity mirror and an AM-FM radio module 595 at the top.

Figure 18:
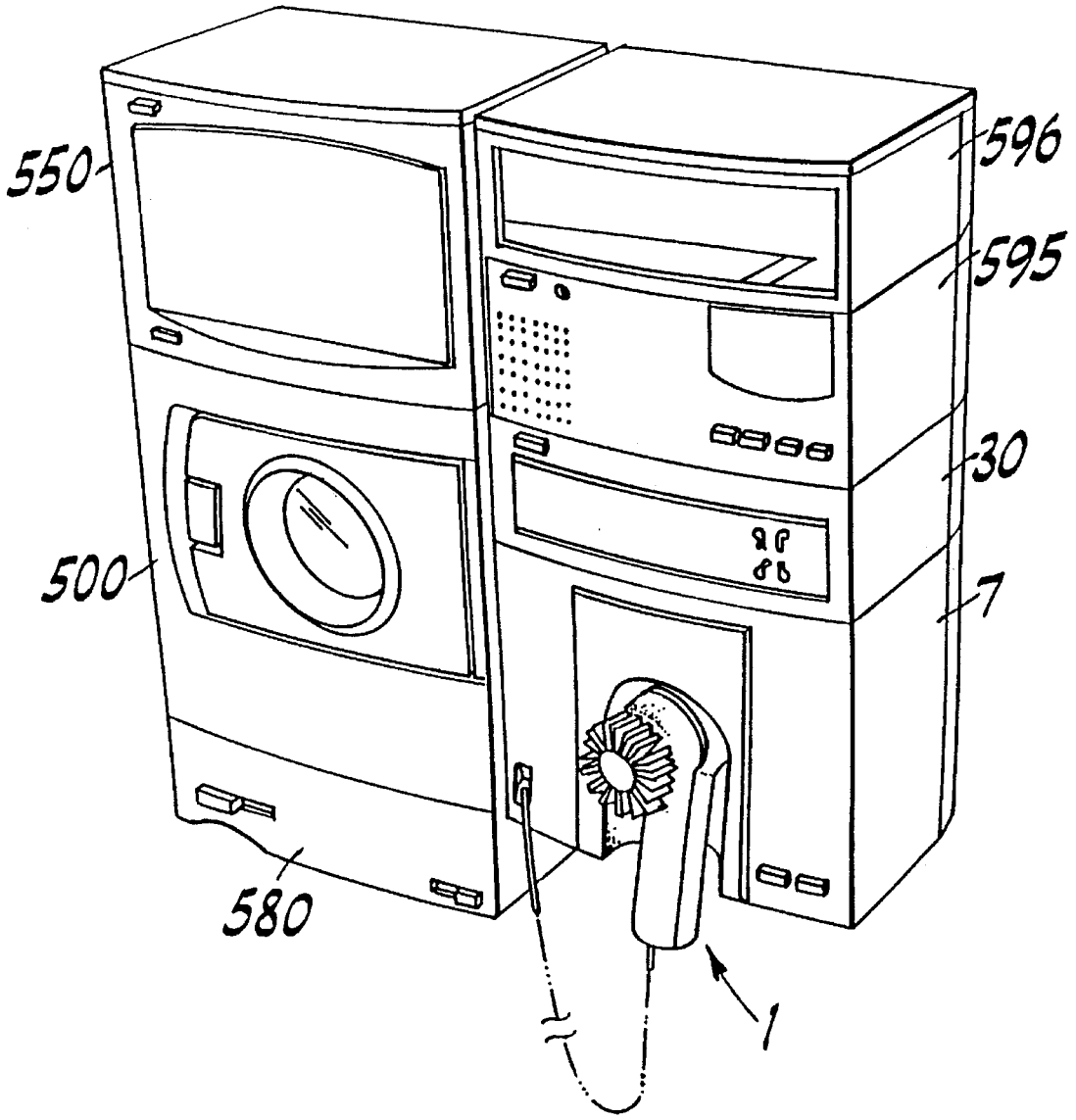
FIG. 18 shows another assembly according to the invention.

FIG. 18 shows another assembly according to the invention and therein is seen a hand-held hair dryer 1 similar to that described in FIG. 1 which is supported in a housing 7. Stacked in succession on the housing 7 are shaver module 30, AM-FM radio module 595 and a module 596 having an illuminable face. Laterally attached to the housing 7 to form a second stack of modules is the garment dryer 500 with the adaptor unit 580 connected at the bottom thereof and at the top of the garment dryer 500 is the adjustable illuminated vanity mirror module 550.

Figure 19:
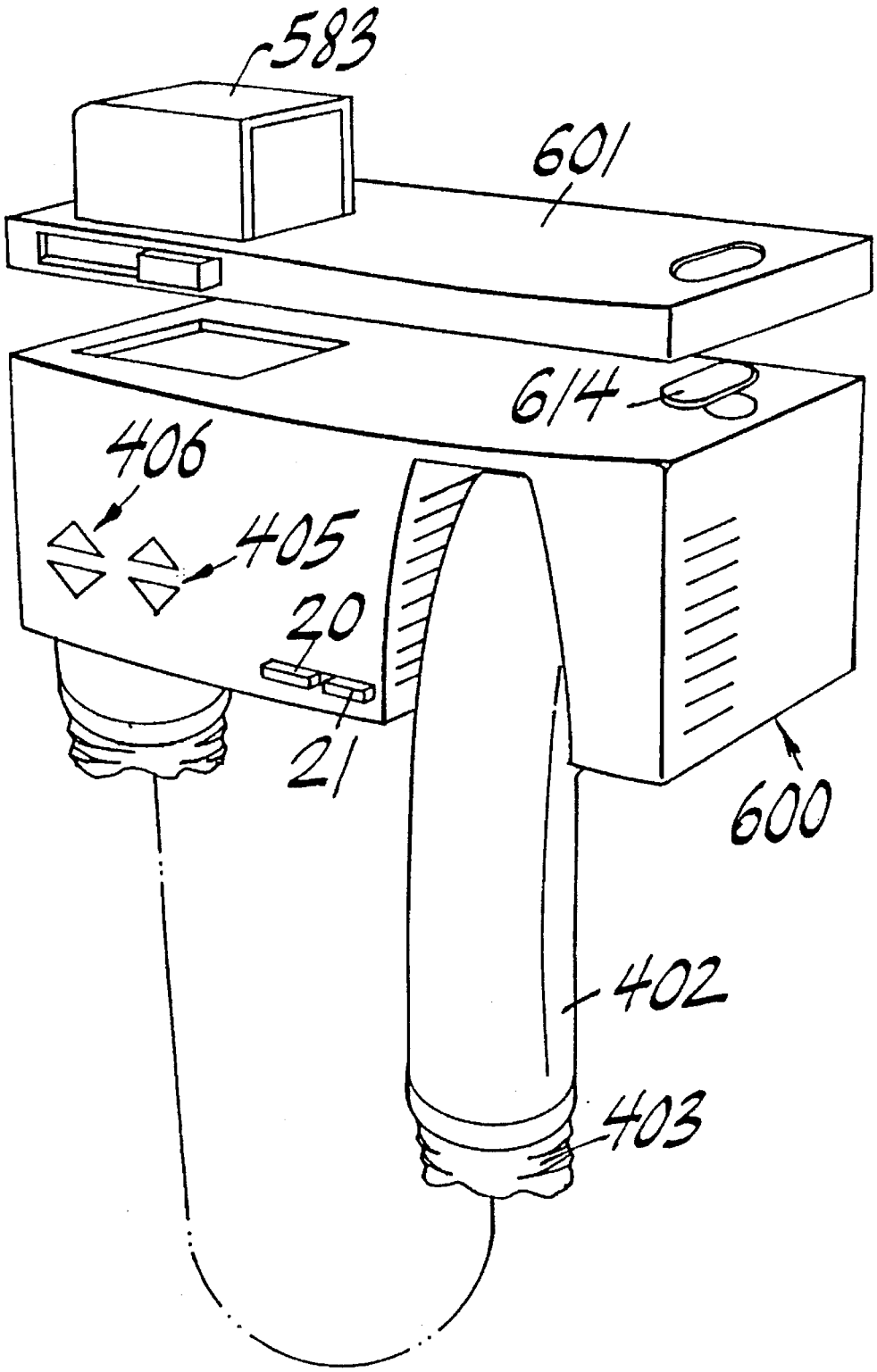
FIG. 19 is an exploded view of another embodiment of the hair dryer with a deflection plate.

FIG. 19 illustrates another embodiment of the hair dryer 600 which is of generally flatter configuration and which omits the shaver outlets. At the top of the hair dryer 600 there is detachably mounted an air director plate 601 similar to the air director plate mounted at the top of the power unit and the top of the adaptor unit. When the air director plate 601 is mounted on top of the hair dryer and the garment dryer is mounted on top of the hair dryer 600 as shown in FIG. 21, the hair dryer 600 also serves as a base unit from which heated air can be directly supplied to the garment dryer without intermediate flow through the hose 403 and the handle 402.

Figure 20:
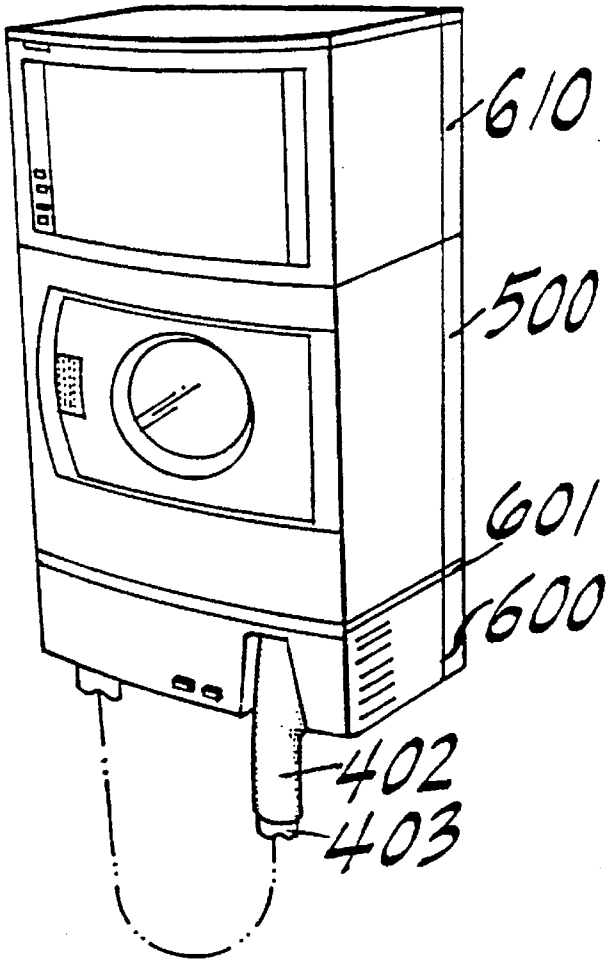
FIG. 20 shows an assembly of the hair dryer of FIG. 19 with the garment dryer and a further accessory module.

In FIG. 20 mounted in succession on hair dryer 600 are garment dryer 500 and a color television module 610.

Figure 21:
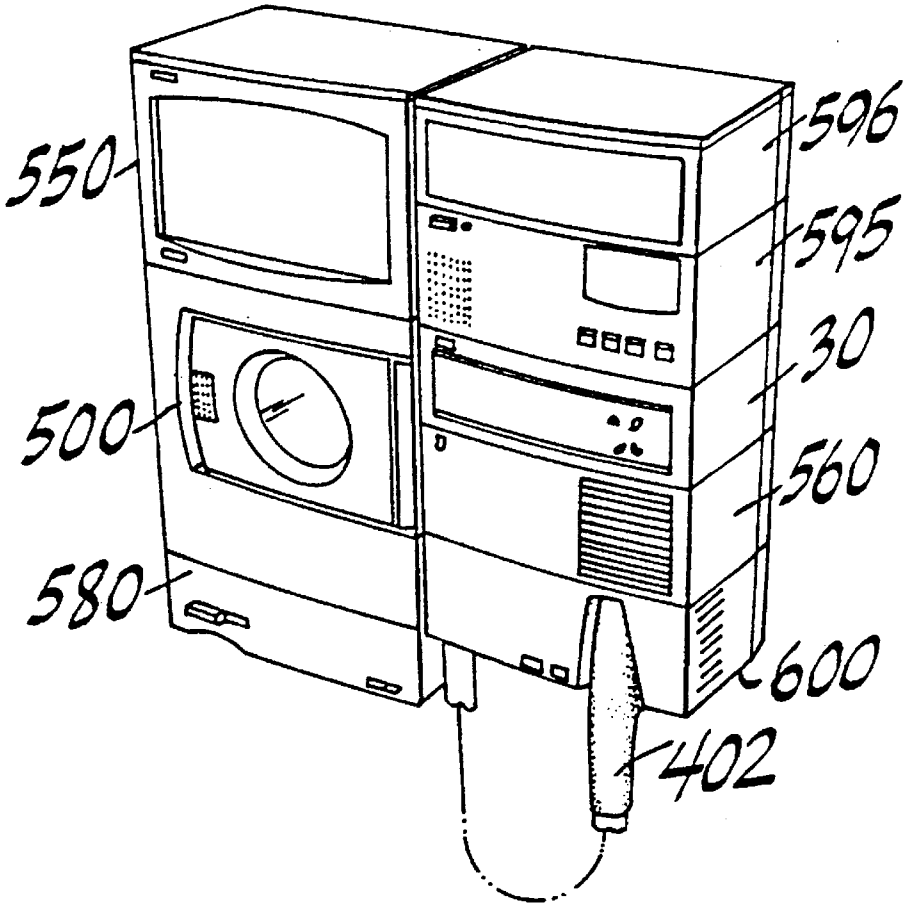
FIG. 21 shows another assembly of the hair dryer in which the deflection plate is omitted and other accessory modules are employed.

FIG. 21 shows another assembly in which the hair dryer 600 is employed as a base unit. Laterally attached to the hair dryer 600 is the garment dryer 500 and the adaptor unit 580.

In this configuration heated air is supplied to the garment dryer by inserting the handle 402 of the hair dryer 600 into the receptacle 583 of the adaptor unit 580. Attached to the top of the garment dryer 500 is the adjustable illuminated vanity mirror module 550 while successively stacked on top of the hair dryer 600 is the room deodorizer module 560, the shaver module 30, the AM-FM radio module 595 and the module 596 with the illuminable face.

In the exploded view shown in FIG. 22 there is seen the hair dryer 400 as the base unit and stacked in succession thereon the AM-FM radio module 595 and the module 596 while laterally attached to the hair dryer 400 is the garment dryer 500 and the adaptor unit 580 and mounted on the garment dryer 500 is the T.V. module 550. Attached by clips to the top of modules 596 and 550 are lids 605. As explained previously with reference to FIG. 9, the modules are connected together by clips and the topmost module is covered by lid 605. Also visible in FIG. 22 at the side wall of hair dryer 400 is a socket 450 connected in the electrical circuit to provide outlet taps for various voltages, such as 220 and 110 volts AC and 12 volts DC.

Figures 23, 23A:
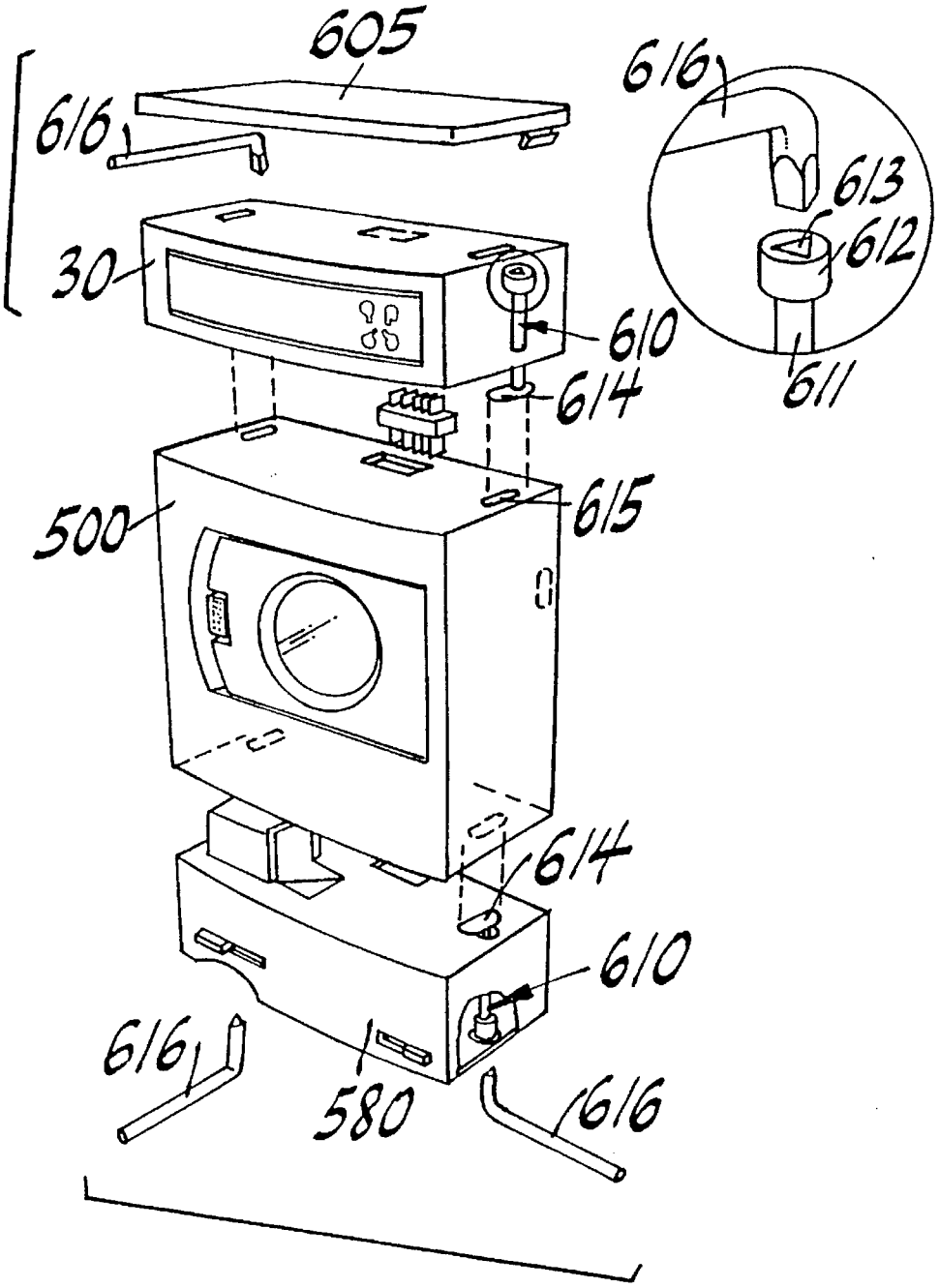
FIG. 23 is an exploded view of a further assembly of modules to illustrate the physical connection therebetween.
FIG. 23A is an enlarged view of a detail of the assembly in FIG. 23.
Figure 24:
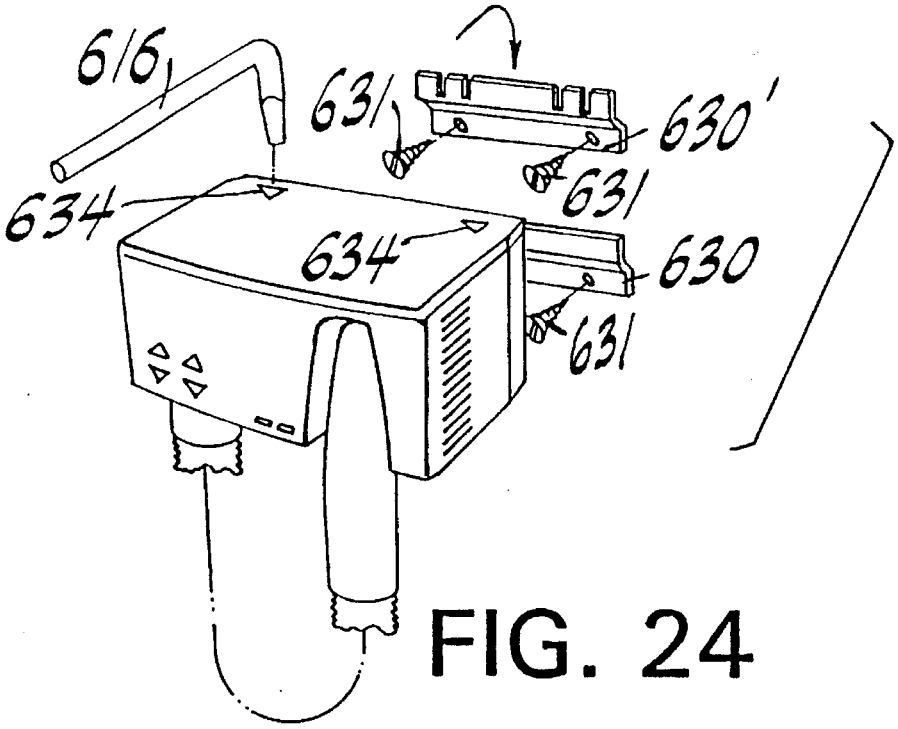
FIG. 24 is a diagrammatic illustration, in exploded view, of a connection between the base unit and the wall.
Figure 25:
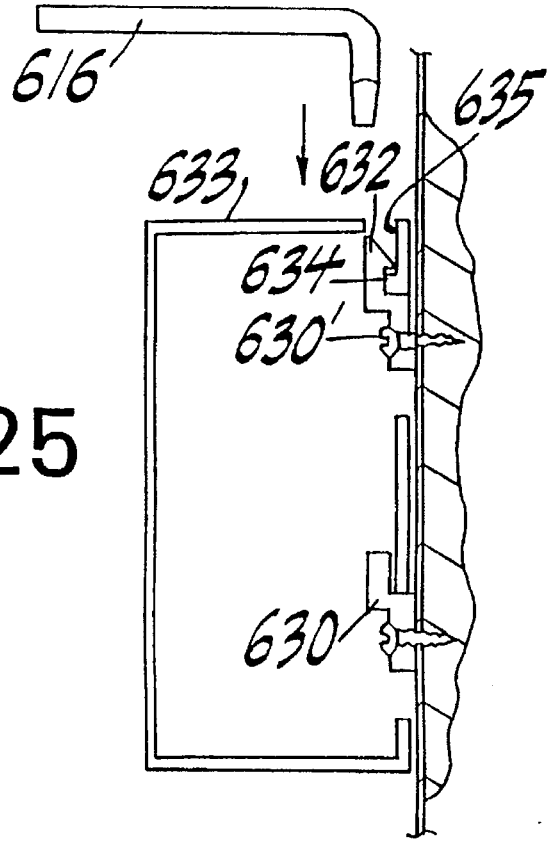
FIG. 25 is a diagrammatic sectional view of the assembled base unit on the wall of FIG. 24.

FIGS. 23, 23A and 24 show detachable security connections between respective units. Referring to FIGS. 23 and 23A a typical connector 610 is shown connecting the shaver module 30 and the garment dryer 500. The connector 610 comprises a shank 611 with a cylindrical head 612 having a triangular slot 613 formed therein. At the bottom of the shank 611 is an offset cam plate 614. When the shaver module 30 is installed on the garment dryer 500, the cam plate 614 is fitted in a slot 615 in the top wall of the garment dryer 500. When the connector 610 is rotated by a tool 616 which engages in the triangular slot in the head 612, the shaver module can no longer be separated from the garment dryer 500. The head 612 of the connector is accessible through an opening in the top of the respective module and this is covered when another module is stacked thereon or when a lid 605 is engaged on the top wall. Removal of the lid 605 is accomplished in the manner as explained with reference to FIG. 9.

FIG. 24 shows an arrangement by which the base unit is connected to the wall with security and in this Figure it is seen that two brackets 630 and 630' are secured to the wall in fixed manner by screws 631. The upper bracket 630' is a locking bracket and has an angulated nose 632 at its upper end which engages an enlarged portion 634 at the bottom of a connector 635. This engagement provides a secure connection which prevents removal of the base unit In the top wall 633 of the base unit there are provided triangular apertures 634 to receive the triangular end of the tool 616. In order to remove the base unit, the triangular end of the tool 616 is inserted into the apertures 634 and pressed downwardly to release the angulated noses 632 of the locking bracket from the enlarged portions 634 at the bottom of the connectors 635 whereby the base unit is now free to be removed from the locking bracket and the wall. The back wall of the base unit slidably engages in the bracket 630.

By virtue of the above connection, the base unit is detachably attached to the wall. The base unit contains the circuit boards of the electrical circuit means for connection to the external electrical supply means and when accessory units are attached to the base unit they receive electrical supply through the electrical interconnectors 410. The base unit provides a flow of heated air which can be utilized by the base unit and/or by a modular accessory unit connected to the base unit.

Figures 26, 26A:
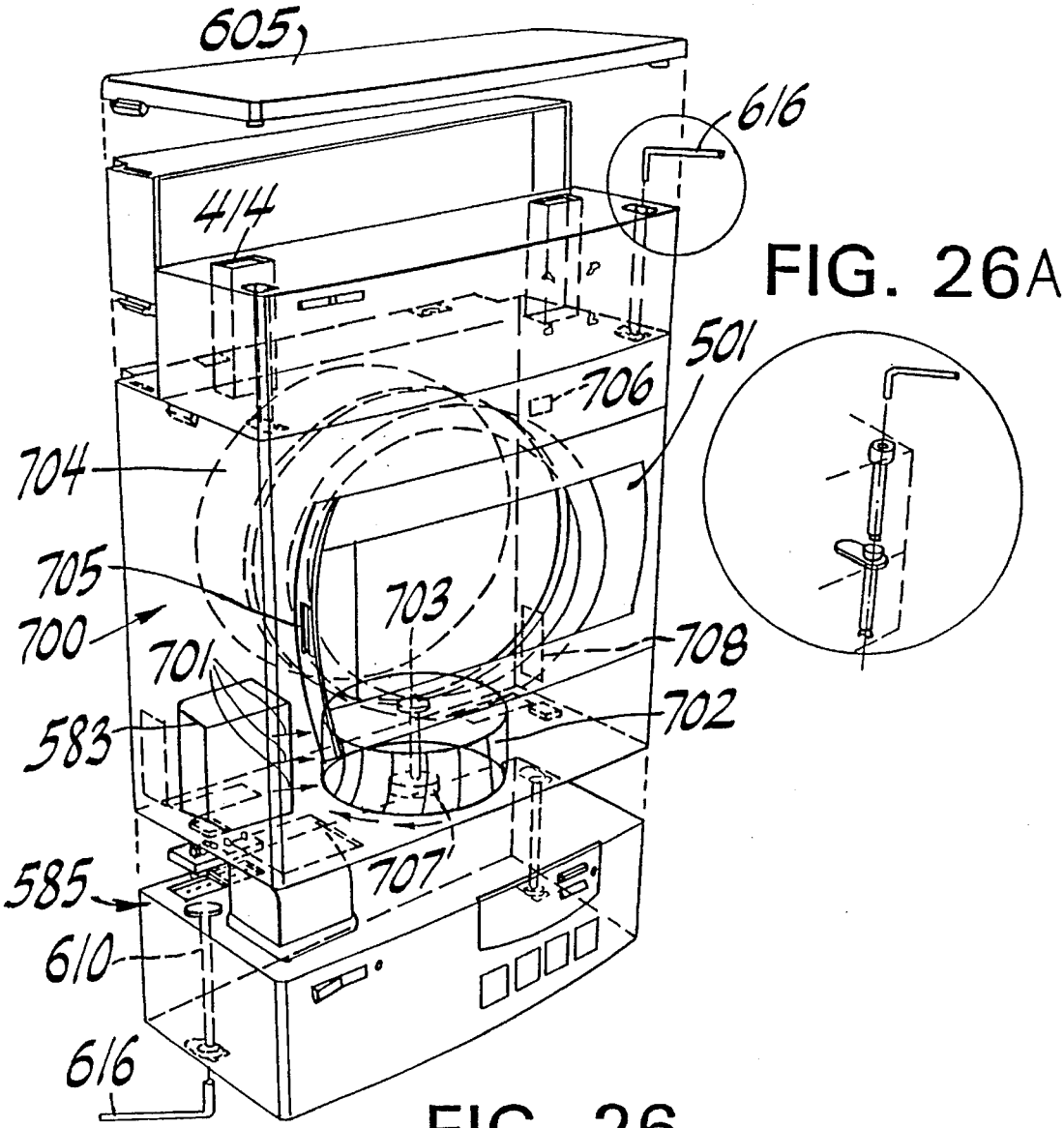
FIG. 26 is a diagrammatic exploded view showing interior details of another embodiment of the garment dryer with a power unit.

Referring to FIG. 26, therein is shown an exploded view of a modified garment dryer 700 in combination with power unit 585. The garment dryer 700 can also be combined with the adaptor unit 580 as previously explained. The modified garment dryer 700 incorporates deflector hood 583 from which heated air is discharged in the direction of the arrows 701 towards the periphery of a rotatable impeller or turbine wheel 702 to cause the turbine wheel to rotate. The turbine wheel 702 is drivingly connected by a gear assembly 703 to a rotatable dryer drum 704 so that the heated air 701 will produce rotation of the dryer drum 704. After rotating the turbine wheel 702, the heated air flows into the interior of the drum 704 via a slot (not shown) in a drum casing (also not shown) to dry garments placed in the drum and then the heated air flows out of the drum 704 through venting openings (not shown) provided at the door 501 of the garment dryer.

Figure 4:
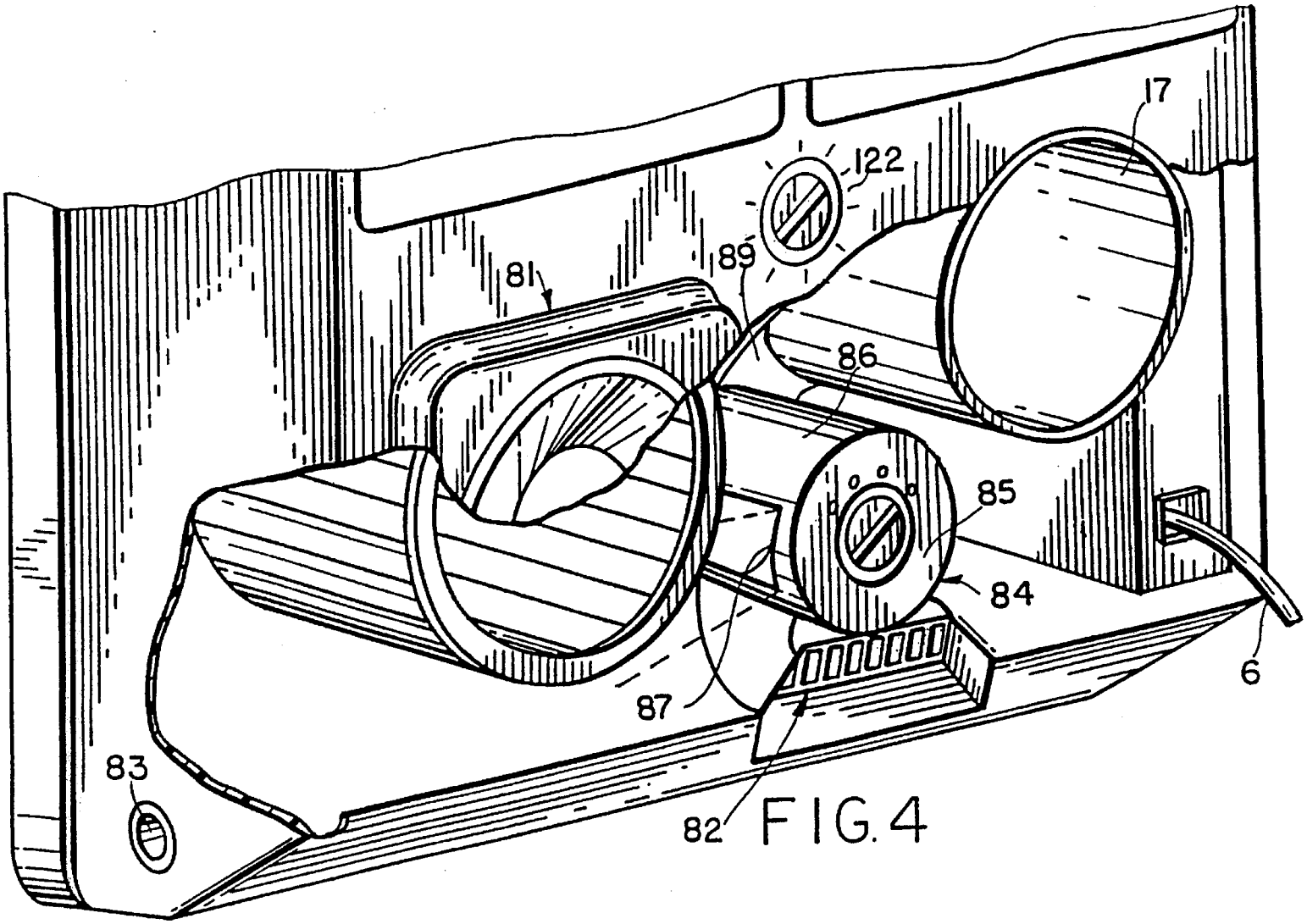
FIG. 4 illustrates, on enlarged scale, a portion of the embodiment in FIG. 3 partly broken away to show internal details.

The drive of the turbine wheel 702 is utilized to carry out a number of functions including, but not limited to, operating a latching mechanism 705 of the door 501 of the garment dryer, sounding an end of cycle alarm 706, operating an air flow control member, such as drum 86 in FIGS. 4 and 5 to divert heated air away from the drum 704 and operating a system for determining the dryness of garments in the dryer.

To achieve the above, the turbine wheel 702 drives an electrical generator 707 or other rotating electrical energy producing device. The electrical energy produced by generator 707 can be used directly to operate electronic and/or electromechanical circuits or the electrical energy can be accumulated for use at the most convenient time. In the latter case, generation of only small amounts of electrical energy are required from the turbine wheel and the total amount of energy over time can be substantial.

Figure 27:
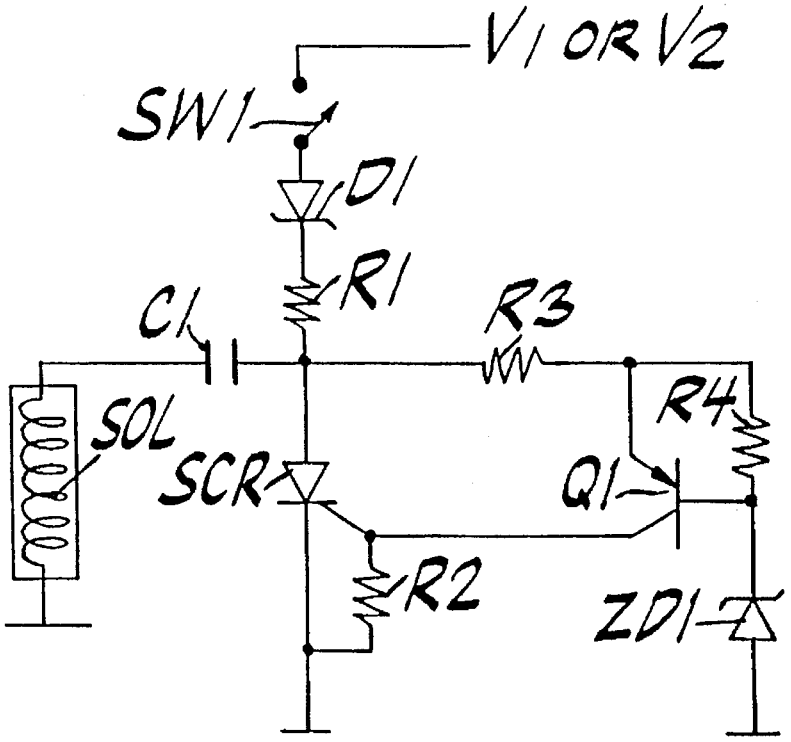
FIG. 27 shows a drive circuit for an operating member.

Referring to FIG. 27, the operation of a solenoid SOL to operate the latching mechanism 705 of the door will now be described. When heated air is applied to the turbine wheel 702 electrical energy V1 or V2 is produced by generator 707 and the energy is stored in a capacitor C1. The circuit of FIG. 27 only allows the solenoid SOL to be energized when a sufficient charge has been accumulated in the capacitor C1. In the circuit, a switch SW1 initiates the supply of electrical energy to the circuit when desired and the switch can be of solid state construction.

Figure 28:
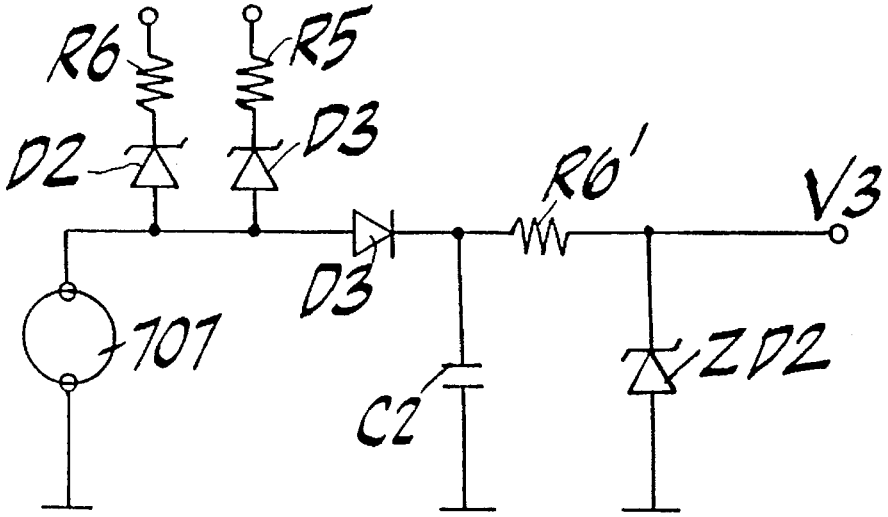
FIG. 28 is a circuit diagram for power supply for the drive circuit of FIG. 27.

When the switch SW1 is closed and voltage at V1 or V2 is supplied from a power supply circuit as shown in FIG. 28, to be described later, capacitor C1 is slowly charged via resistor R1 and diode D1 by generator 707. When there is sufficient voltage in the circuit to turn Zener diode ZD1 on through the base and emitter of transistor Q1, current will then flow to resistor R3 and Zener diode ZD1. This will then turn the collector of transistor Q1 on and current will flow into the gate of silicon controlled rectifier SCR. The silicon controlled rectifier SCR will latch on and cause capacitor C1 to discharge through the solenoid SOL. The now energized solenoid will drive its armature and operate the latching mechanism 705 of the door 501. Resistors R4 and R2 serve to reduce the effects of noise activation of the circuit.

FIG. 28 shows the power supply distribution circuit of the generator 707. The generator 707 is connected to diodes D2 and D3 which in turn, are connected respectively to resistors R5 and R6 for supply of voltages V2 and V1 respectively, to feed the circuit of FIG. 27. The power distribution circuit of FIG. 28 can also be used to supply voltage to other suitable electrically operated devices, as previously stated, and as will be described in more detail later. The resistors R5 and R6 are current limiting resistors to prevent overloading of the generator 707.

V3 represents a DC output of voltage which is regulated for supply to an electronic utilization means. Between the electrical generator 707 and the output V3 are a diode D3 and a capacitor C2. The capacitor is intended to smooth the output at V3. Resistor R6' serves as a current limiter while Zener diode ZD2 serves as a voltage regulator.

In operating the door latch mechanism 705, the capacitor stores energy as a DC charge and the energy is released to the solenoid SOL to operate the latch mechanism. The time for storing the charge may take from several tens of milliseconds to several seconds depending on the size of electrical generator 707, the magnitude of air flow, and the energy requirements of the solenoid. In any event, shortly after the heated air is supplied to the tumble dryer, the door mechanism is latched by energyization of the solenoid. The control of the time of release of energy from the capacitor C1 to the solenoid SOL is controlled by the circuit of FIG. 27 where there is a voltage threshold protection based on the stored energy measurement of the voltage across the storage capacitor C1. Any suitable electronic comparator coupled to a solid state switch could also be utilized to control the supply of the stored capacitor energy to the solenoid. It is also contemplated that a polarity reversal means can be employed so that the armature of the solenoid can be moved in opposite directions in order to open and close the door 501 at suitable periods of time.

As previously stated, the electrical energy derived from the driven turbine wheel 702 can also be used to drive electronic circuits to perform a number of functions. One such function is the determination of the dryness of the garments in the dryer. In this respect, a conventional electronic circuit for dryness determination is provided which is supplied with electrical energy from the generator 707. In general, the residual water content in the exhaust air of the dryer is either indirectly or directly measured by a sensor 708 to determine an end of cycle condition. A total duration timer can also be incorporated for added system security against misuse or spurious conditions.

Upon reaching the determined end of cycle condition, the end of cycle alarm is sounded and the air flow control member is operated to divert the heated air away from the drum 704. The alarm system can be any suitable piezoelectric or other electromechanical device which emits an audible sound when activated by an electronic circuit. Alternatively, the alarm device can be an electromechanical system which causes air to flow for a period of time through a reed device to produce an audible sound.

After the air flow control means has been operated to divert the air away from the drum 704 and thereby away from the garments therein, a cool down cycle can be initiated for a period of time. During this interval, the drum continues to rotate on its own and cool air entering the drum prevents the heated garments from settling on top of each other to produce creases therein.

By generating electrical energy from the powered turbine wheel, no electrical connection to an outside power source is necessary for the automatic operation. Hence, the door latch and cycle functions can be completely automatic or they can be operated by a control key driven by the power circuit to sense and activate the system.

It is also within the contemplation of the invention to sense any increase of temperature in the dryer above a critical value, usually of the order of 80° C., whereupon heated air to the drum will be automatically bypassed. A thermistor or other temperature responsive device can be employed in the flow of exhaust air from the dryer to control the operation. The response of the system is then of a modulating bypass temperature control action. Of course, with reduced electronic control power requirements a variety of advance sensing systems can be employed all due to the availability of electrical energy produced by the air driven turbine wheel.

Although the invention has been described in relation to specific embodiments thereof, it will become apparent to those skilled in the art that numerous modifications and variations can be made within the scope and spirit of the invention as defined in the attached claims.

What is claimed is:

1. Apparatus adapted for multi-functional use with selected base and accessory units comprising a base unit including a housing attachable to a wall, circuit means in said housing for connection to an electrical supply means, said circuit means providing an electrical outlet connection externally of said housing, means in said housing connected to said circuit means for producing a flow of heated air from said housing when the circuit means is connected to said electrical supply means, a plurality of modular accessory units at least one of which is operable by the heated air from said housing and at least a second of which is electrically operated, and means for detachable connection of a selected modular accessory unit to said housing, said at least second modular accessory unit including an electrical interconnection means which electrically connects the second modular accessory unit to said circuit means when the second modular accessory unit is detachably attached to said base unit, said at least one modular accessory unit being operated by the heated air from said base unit when detachably attached to said base unit.

2. Apparatus adapted for multi-functional use as claimed in claim 1 wherein said means for detachable connection comprises a security connection between said base unit and said selected modular accessory unit connected thereto, said security connection being secured and unsecured by a tool having a head shaped to engage said security connection to secure and unsecure the connection between the base unit and said selected modular unit.

3. Apparatus adapted for multi-functional use as claimed in claim 2, comprising a further security connection between said base unit and said wall.

4. Apparatus adapted for multi-functional use as claimed in claim 1, wherein said electrical interconnection means comprises an electrical interconnector to connect the base unit to the accessory units and the accessory units to one another.

5. Apparatus adapted for multi-functional use as claimed in claim 4, wherein the base unit and the accessory units include electrical sockets each of which receives a respective said electrical interconnector to electrically connect the units to one another.

6. Apparatus adapted for multi-functional use as claimed in claim 5, wherein each electrical interconnector comprises a body including two sets of male interconnector elements for connection with respective sockets of the interconnected units.

7. Apparatus adapted for multi-functional use as claimed in claim 1, wherein said base unit comprises a hair dryer including a handle for discharging heated air from the hair dryer.

8. Apparatus adapted for multi-functional use as claimed in claim 7, which further comprises a hose connecting said hair dryer to said housing for conveying heated air to said hair dryer.

9. Apparatus adapted for multi-functional use as claimed in claim 7, wherein said at least one modular accessory unit comprises a garment dryer which receives heated air from the hair dryer for operation of the garment dryer.

10. Apparatus adapted for multi-functional use as claimed in claim 9, comprising an adaptor unit detachably connected to said garment dryer and including a manifold to convey heated air from the hair dryer to said garment dryer, said garment dryer having an opening for receiving said handle of the hair dryer so that heated air therefrom flows to said manifold.

11. Apparatus adapted for multi-functional use as claimed in claim 10, wherein said manifold includes an air director hood.

12. Apparatus adapted for multi-functional use as claimed in claim 1, wherein said base unit comprises a power unit and said at least one accessory unit comprises a garment dryer, said power unit including a manifold to convey heated air produced by said base unit to said garment dryer.

13. Apparatus adapted for multi-functional use as claimed in claim 1, wherein said plurality of modular accessory units are stacked one on top of the other.

14. Apparatus adapted for multi-functional use as claimed in claim 1 wherein said at least one modular accessory unit comprises a garment dryer including a rotatable drum and a turbine wheel drivingly coupled to said drum and driven by said heated air.

15. Apparatus adapted for multi-functional use as claimed in claim 14, further comprising electrical generating means driven by said turbine wheel and electrical utilization means connected to said electrical generating means for being supplied with electrical energy therefrom.

16. Hair dryer apparatus adapted for multi-functional use comprising a hair dryer including a housing attachable to a wall, a handle having an air outlet, electrical power supply means within said housing, electrical heating means for producing heated air means electrically connecting said electrical heating means, to said electrical power supply means, switch means for controlling electrical connection of said electrical heating means to said electrical power supply means, said hair dryer producing heated air at said air outlet of said handle when said electrical heating means is connected to said electrical power supply means, said housing including a receptacle for said handle, a plurality of modular accessory units, means for detachable connection of a selected modular accessory unit to said housing, circuit means connected to said electrical power supply means for providing an electrical outlet connection in said housing, at least one of said modular accessory units including electrical utilization means with an input which is electrically connected to said electrical outlet connection when said accessary unit is connected to said housing.

17. Hair dryer apparatus as claimed in claim 16, wherein at least one other of said accessory units includes heated air utilization means and means for receiving heated air from said outlet of said handle.

18. Hair dryer apparatus as claimed in claim 16, wherein said accessory units and said housing include snap-fit connection means.

19. Hair dryer apparatus as claimed in claim 16, comprising a GFCI in said circuit means.

20. Hair dryer apparatus as claimed in claim 19, wherein each of said plurality of modular accessory units is electrically connected to said electrical power supply means through a respective electrical outlet connection via said circuit means and said GFCI.

21. Hair dryer apparatus as claimed in claim 16, wherein said housing and said modular accessories are interchangeably engageable.

22. Hair dryer apparatus as claimed in claim 16, wherein said means for detachable connection comprises a security connection between said housing and said modular accessory unit connected thereto, said security connection being secured and unsecured by a tool having a shaped head.

23. Hair dryer apparatus as claimed in claim 16, wherein said accessory units include electrical interconnectors for connecting the accessory units to said housing and to one another.

24. Hair dryer apparatus as claimed in claim 23, wherein each electrical interconnector includes two sets of male connector elements respectively and selectively engageable in sockets in said accessory units and in said housing.

25. A method of providing a multi-functional arrangement of a base unit and a plurality of accessory units in which heated air is produced for utilization by a user, said method comprising:

connecting the base unit to a support, providing a plurality of accessory units having respective uses, providing an electrical circuit including a GFCI in said housing for connection with an external power source, detachably connecting one or more accessory units to the base unit, establishing electrical connection to said accessory unit when said accessory unit is connected to the base unit and electrical connection from said accessory unit to any successive accessory unit connected thereto, and producing heated air in one of said units for utilization by a user.

26. A method as claimed in claim 25, wherein said heated air is produced in said base unit.

27. A method as claimed in claim 26, comprising conveying said heated air from said base unit to one of said accessory units for utilization thereby.

28. A method as claimed in claim 25, wherein said accessory units are connected by stacking one on the other.

29. A method as claimed in claim 25, wherein said one accessory unit is a garment dryer including a rotatable drum, said method further comprising driving said drum in rotation by a turbine wheel driven by said heated air.

30. A method as claimed in claim 28 comprising generating electrical power upon the driving of said turbine wheel and utilizing said electrical power to operate an electrical utilization means.

* * * * *